US008186640B2

(12) United States Patent
Bertrand

(10) Patent No.: US 8,186,640 B2
(45) **Date of Patent: *May 29, 2012**

(54) PORTABLE DRAWING APPARATUS

(75) Inventor: Vic Bertrand, Beaconsfield (CA)

(73) Assignee: MEGA Brands International, Luxembourg, Zug Branch (CH)

( * ) Notice: Subject to any disclaimer, the term of this patent is extended or adjusted under 35 U.S.C. 154(b) by 60 days.

This patent is subject to a terminal disclaimer.

(21) Appl. No.: 12/947,885

(22) Filed: Nov. 17, 2010

(65) Prior Publication Data

US 2011/0057087 A1 Mar. 10, 2011

Related U.S. Application Data

(63) Continuation of application No. 11/874,502, filed on Oct. 18, 2007, now Pat. No. 7,857,277.

(60) Provisional application No. 60/852,657, filed on Oct. 19, 2006.

(51) Int. Cl.
*A47B 97/04* (2006.01)

(52) U.S. Cl. ..... 248/464; 248/461; 248/462; 248/463

(58) Field of Classification Search ..... 248/166, 248/461–465, 465.1; 211/182, 192
See application file for complete search history.

(56) References Cited

U.S. PATENT DOCUMENTS

| | | | |
|---|---|---|---|
| 2,196,044 | A | 4/1940 | Tyrrell |
| 2,376,063 | A | 5/1945 | Klick |
| 3,153,872 | A | 10/1964 | Noel |
| 3,370,821 | A | 2/1968 | Mingis |
| 3,815,860 | A | 6/1974 | Bompart |
| 4,083,579 | A | 4/1978 | Basey, Jr. et al. |
| 4,453,470 | A | 6/1984 | Capella |
| 4,714,224 | A | 12/1987 | Calmes |
| 4,856,749 | A | 8/1989 | Habermann |
| 4,856,809 | A | 8/1989 | Kohus et al. |
| 5,081,936 | A | 1/1992 | Drieling |
| 5,308,035 | A | 5/1994 | Ross |
| 5,351,843 | A | 10/1994 | Wichman et al. |
| D358,511 | S | 5/1995 | Frahm |
| 5,680,973 | A | 10/1997 | Vulpitta et al. |
| 5,782,185 | A | 7/1998 | Frahm et al. |

(Continued)

FOREIGN PATENT DOCUMENTS

| | | |
|---|---|---|
| CA | 2 136 539 | 4/2006 |

(Continued)

OTHER PUBLICATIONS

Mega Bloks—Build 'n' Go Easel, http://www.drtoy.com/1999_b/mega_bloks.htm, retrieved Oct. 18, 2007, 1 page.

(Continued)

*Primary Examiner* — Gwendolyn Baxter
(74) *Attorney, Agent, or Firm* — Plumsea Law Group, LLC

(57) ABSTRACT

A portable drawing apparatus configured to act as an easel and/or desk includes a pair of upper support members each pivotally connected to a respective lower support member, and also each pivotally connected to a respective rear support member. In an operational configuration, the rear support members can project rearwardly in a plane substantially normal to a plane defined by two mutually parallel upper support members. A lower cross frame and upper cross frame are each connected to respective lower support members, and upper support members, and each further connected to the non-removable portion. A hinged lateral member, when configured in a locked position, defines the apparatus width. In a collapsed configuration, the distal portions of the upper and lower support members are configured to point in the same direction and form a bundle whose length is substantially less than that of the apparatus length in operational configuration.

20 Claims, 17 Drawing Sheets

U.S. PATENT DOCUMENTS

| | | | |
|---|---|---|---|
| D413,209 | S | 8/1999 | Jarke |
| 6,050,200 | A | 4/2000 | Sullins et al. |
| 6,170,405 | B1 | 1/2001 | Weitzman et al. |
| 6,173,656 | B1 | 1/2001 | Blanchard |
| 6,957,612 | B2 | 10/2005 | Conlee |
| 7,055,442 | B2 | 6/2006 | Podd et al. |
| 7,717,377 | B1 | 5/2010 | Corrado |
| 2006/0016951 | A1 | 1/2006 | Nash et al. |

FOREIGN PATENT DOCUMENTS

| | | |
|---|---|---|
| FR | 2 836 033 | 8/2003 |

OTHER PUBLICATIONS

International Search Report and Written Opinion of the International Searching Authority dated Apr. 7, 2008 in PCT/IB2007/003126.
English language Abstract of FR 2836033.

PORTABLE DRAWING APPARATUS

This application is a continuation of U.S. application Ser. No. 11/874,502, filed Oct. 18, 2007, which claims the benefit of U.S. Provisional Application No. 60/852,657 filed Oct. 19, 2006, both of which are herein incorporated by reference in their entirety.

BACKGROUND

1. Field of the Invention

The present invention relates generally to drawing apparatus that provide a drawing surface, and more particularly, to an easel-type drawing structure.

2. Background of the Invention

Users of writing and drawing instruments, such as artists and children, are continually in pursuit of devices that facilitate the ability to draw, such as devices that provide positionable drawing surfaces like easels. Easels typically provide a surface that allows a permanent (permanent paint) or erasable (blackboard-type easel) picture to be created thereon. Although many easels can in principle be moved, portability of such drawing structures tends to be limited because of their large size.

BRIEF SUMMARY OF THE INVENTION

In one aspect of the present invention, a collapsible easel-type apparatus is provided. One configuration of the present invention provides a collapsible easel that includes four support members configured to rest on a horizontal surface such as a floor, and a substantially flat drawing support surface that extends above the four support members. The four support members include a pair of lower support members and a pair or rear support members. In one configuration of the invention, in an operable state (configuration), the drawing support surface is formed by a flexible sheet that extends between two parallel drawing surface support members. In one configuration, in an operable state, the drawing support surface is a planar surface that is substantially co-planar with a plane defined by the drawing surface support members. According to one aspect of the invention, in a portable state (configuration), the lower and rear support members and drawing support surface members are configured to collapse into a bundle comprising substantially parallel members in a manner analogous to a collapsible stroller (which is also sometimes referred to as an umbrella stroller).

According to an embodiment of the present invention, a portable drawing apparatus comprises a pair of drawing surface support members arranged as narrow elongated structures. Each drawing surface support member is configured to connect to a drawing surface along an opposite edge of the drawing surface. The portable drawing apparatus also includes a pair of lower support members arranged as narrow elongated structures, where each lower support member pivotally connects to a respective drawing surface support member, and a pair of rear support members arranged as narrow elongated structures, each rear support member also pivotally connected to a respective drawing surface support member. A lower cross member is provided that has first and second members pivotally connected to each other in a center region. The lower cross member is connected to a distal region of each lower support member and to the rear support members. An upper cross member is provided that has first and second members pivotally connected to each other in a center region. The upper cross member is connected to a distal region of each drawing surface support member and to the rear support members. A lateral member comprising two portions rotatable about a common pivot is also provided in the portable drawing apparatus. The lateral member is connected at each of two ends to one of a respective rear support member, an upper support member, and a lower support member.

Accordingly, in an operational configuration, the drawing support surface forms a planar upwardly facing surface connected to each of the drawing surface support members along opposite edges of the drawing surface, each lower support member is substantially parallel to a respective drawing surface support member, wherein, with respect to a common hinge, the distal ends of the lower support members extend in an opposite direction to that of the distal ends of the drawing support surface members. The rear support members and lower support members are configured to rest on a common substantially planar surface, wherein each rear support member extends at a substantial angle with respect to the drawing surface support members.

Furthermore, in a collapsed configuration, the portable drawing apparatus is operable such that the drawing surface support members and lower support members can be made substantially mutually parallel, with their respective distal ends substantially adjacent to each other, pointing in a same direction with respect to the common hinge, such that the drawing surface support members, the lower support members, and at least a portion of the rear support members form a bundle.

In a further embodiment of the present invention, a portable easel comprises a drawing support surface, a pair of upper support members that are substantially mutually parallel and each configured to connect to the drawing support surface along opposite sides of the drawing support surface, and a pair of lower support members. Each lower support member is pivotally connected through a hinge to a respective upper support member, wherein the upper support and the lower support members are configured such that their distal ends can form a mutual angle with respect to the hinge that spans a range from about zero degrees to about one hundred eighty degrees. The portable easel further includes a pair of rear support members each pivotally connected to an upper support member. A lower cross frame comprising two members pivotally connected in their respective central regions is also provided. The lower cross frame is connected on each of a pair of distal ends of the two members to a respective lower support member and on each of a second pair of distal ends of the two members to a respective rear support member. An upper cross frame is provided, which comprises two members pivotally connected in their respective central regions. The upper cross frame is connected at each of a pair of distal ends to a respective upper support member and at each of a second pair of distal ends to a respective rear support member. A hinged lateral member is also provided that comprises two portions rotatable about a common pivot and configured to engage into a locked position defining a substantially straight line. The hinged lateral member is connected at each of two ends to a respective rear support member, upper support member, or lower support member.

In an operational configuration, the hinged lateral member is disposed in the locked position, and the upper, lower and rear support members form a substantially rigid easel frame in which the upper and lower support members define a substantially planar inclined surface having a substantially rectangular shape whose lateral dimension is about that of the hinged lateral member. Preferably, in the operational configuration, each upper support member defines a plane with its respective connected rear support member that is substantially perpendicular to the planar inclined surface.

Furthermore, in a collapsed configuration, the lower support members, upper support members, rear support members, upper and lower cross support members, and hinged lateral member are collapsed into a bundle, wherein the upper and lower support members are operable such that their distal ends point in substantially the same direction with respect to the hinge.

The cross-sectional diameter of the collapsed bundle can be less than about half of the width of the easel when in operational configuration. In preferred embodiments of the invention, the length of the collapsed bundle is less than the length of the easel in operational configuration, such that the bundle, as well as easel accessories can be stored and carried in an elongated carry bag having dimensions of about several feet in length and about one foot or less in diameter.

In a further embodiment of the present invention, a portable drawing apparatus comprises a drawing support surface, a pair of mutually parallel upper support members each configured to connect to the drawing support surface along opposite sides of the drawing support surface. A pair of lower support members is provided, wherein each lower support member pivotally connects through a hinge to a respective upper support member, wherein the upper support and the lower support members are configured such that their distal ends can form a mutual angle with respect to the hinge that spans a range from about zero degrees to about one hundred eighty degrees. A pair of rear support members are provided that are each pivotally connected to one of an upper support member and a lower support member. A hinged lateral member is provided that comprises two portions rotatable about a common pivot. The hinged lateral member is arranged so that in a locked position it defines a substantially straight line connected on opposite ends to one of a pair of rear support members, a pair of lower support members, and a pair of upper support members. Also provided are a lower cross frame comprising two members pivotally connected in their respective central regions, the lower cross frame reversibly connectable on each of a pair of distal ends to a respective lower support member and on each of a second pair of distal ends to a respective rear support member, and an upper cross frame comprising two members pivotally connected in their respective central regions, the upper cross frame connected on each of a pair of distal ends to a respective upper support member and on each of a second pair of distal ends to a respective rear support member.

In an operational configuration, the hinged lateral member is disposed in a locked position, the upper, lower, and rear support members define a substantially rigid easel support surface in which the upper and lower support members define a substantially planar inclined surface having a substantially rectangular shape whose lateral dimension is about that of the hinged lateral member. Furthermore, in the operational configuration, the portable drawing apparatus is configured to retain a substantially horizontal support surface disposed between sides of the portable drawing apparatus, the lower cross member is configured to fold out of the way of a person seated with legs at least partially below the horizontal support surface.

In a collapsed configuration, the lower support members, upper support members, rear support members, upper and lower cross support members, and hinged lateral member are collapsed into a bundle, wherein the upper and lower support members are configured such that their distal ends point in the same direction with respect to the hinge.

DETAILED DESCRIPTION OF THE INVENTION

Figure 1A:
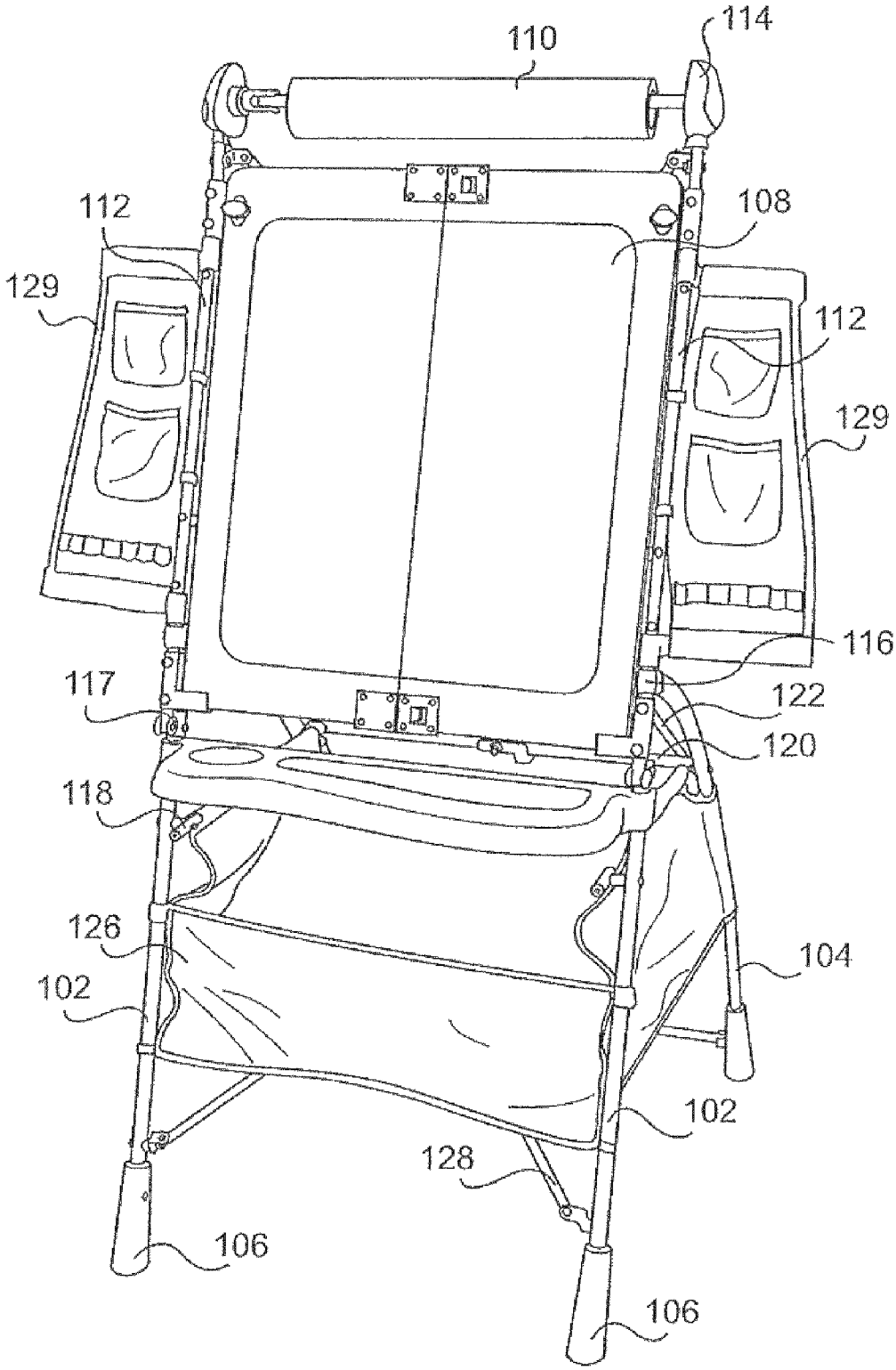
FIGS. 1*a* and 1*b* are schematic diagrams that depict perspective views of a collapsible easel in operable and portable states, respectively, according to one aspect of the present invention.

Aspects of the present invention are related to a portable easel that can be rapidly set up, rapidly collapsed, and conveniently transported and stored in a relatively small space as compared to the portable easel size when in use. The portable easel according to the present invention can vary in overall size according to desired applications. A desktop easel may be, for example, two feet or less in height, while a child's easel may be about four feet in height and an adult easel about six feet in height. In all cases, the collapsed state of the easel occupies substantially less space than its operational state.

A portable easel arranged in accordance with the present invention can provide the functionality of a known easel type apparatus, such as the ability to hold a drawing surface of a similar shape and size of conventional easels, as well as the positioning of the drawing surface at an angle and height similar to conventional easels. By providing a frame that can be collapsed in one or a few steps, the portable easel can be conveniently stored in smaller spaces than conventional easels and can be more conveniently transported.

In other aspects of the present invention, an easel is provided with convenient means for attaching and detaching accessories, such as paint trays, marker/paintbrush/chalk holders, and storage compartments, as wells as dispensers of consumable drawing surfaces, such as paper rolls.

In still other aspects of the present invention, a portable drawing apparatus configured to operate as a portable easel is additionally configured to retain a horizontal support surface in an operational configuration, wherein the portable drawing apparatus has the capability of acting as a desk as well as an easel.

FIG. 1*a* is a schematic diagram that depicts a perspective view of a collapsible easel 100 in an operable state, according to one aspect of the present invention. The terms "operable state," or "operable configuration," as used herein, refer to a configuration of the easel in which normal drawing can take place. As such, lower support members 102 and rear support members 104 are configured to engage a horizontal surface, or substantially horizontal surface, such as a floor. In the example shown, support members 102 and 104 are provided with bases 106, which, in one configuration, comprise a flexible material, such as rubber. In alternative configurations, bases 106 could be suction cups, wheels, rollers, casters, or combinations thereof.

Drawing support surface (also termed "support surface" herein) 108 extends above lower support members 102, so that a standing person can conveniently draw on a medium, such as sheet roll 110 that can be pulled across support surface 108. Alternatively, single sheets of medium (e.g., paper or canvas) can be cupped or otherwise attached to support surface 108. In another configuration, support surface 108 itself includes an integral medium, such as a dry-erase marker surface, a flexible chalkboard, a flexible ferromagnetic substrate for receiving magnets, a flexible magnetic display panel (e.g., using black magnetic particles drawn to the surface by magnetic pens), or a water-activated substrate (e.g., displaying underlying darker substrates when wetted by a water pen). Thus, the term "drawing support surface," as used herein, can refer to a surface that itself is used to draw upon, as well as a surface that acts as a support for a second drawing surface, such as a paper sheet, to rest upon.

The terms "draw" and "drawing," as used herein, refer generally to manual operations such as writing, sketching, crayon drawing, water pencil drawing, and painting, but could also include other actions that can be performed on an easel surface, such as splattering of paint. In the configuration shown in FIG. 1*a*, drawing support surface 108 lies between drawing surface support members 112, which are attached to lower support members 102 by support hinges 117. Drawing support surface 108 can be, for example, a flexible fabric material (e.g., nylon or canvas) that is stretched between drawing surface support members 112 when easel 100 is in an operable state. Drawing surface support members 112 preferably pull drawing support surface 108 taut to provide adequate support for drawing.

Figure 1B:
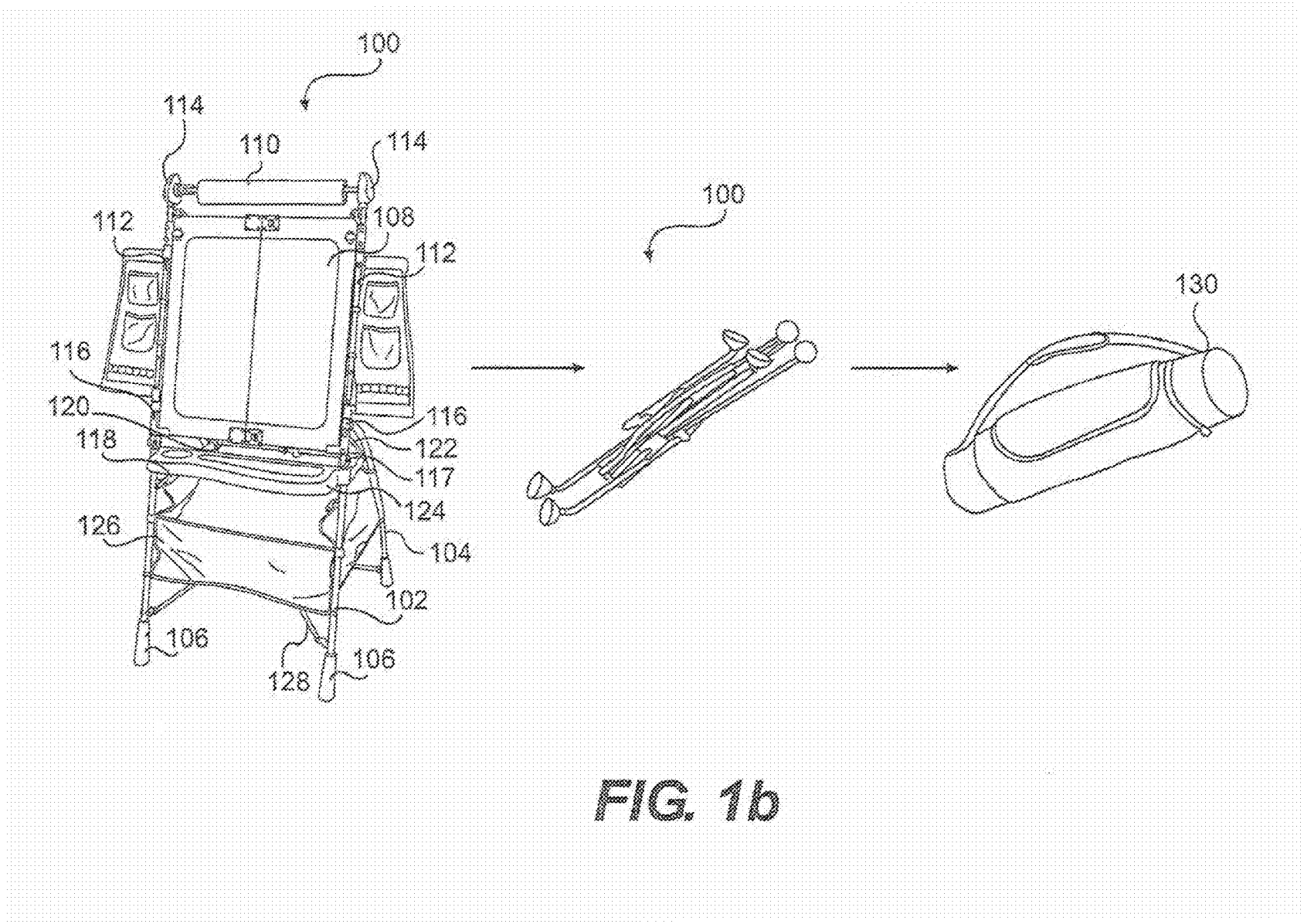

In the configuration of the invention illustrated in FIG. 1*a*, sheet roll supports 114 are disposed at the ends of drawing surface support members 112 opposite hinges 117. Sheet roll supports 114 can act as supports for a disposable sheet roll 110 in the manner of a paper towel holder. Disposable sheet roll 110 can be removed from between roller supports 114 so that drawing surface support members 112 can be collapsed together, as illustrated in FIG. 1*b*. Although shown as spherical, sheet roll supports 114 could, of course, use other means for retaining sheet roll 110, such as spring loaded arms.

Support hinges 116 provide for relative rotation of rear support members 104 with respect to drawing surface support members 112, between, for example, an operable position illustrated in FIG. 1*a*, in which the longitudinal direction of members 104 and 112 form an angle with respect to one another, and a fully collapsed position illustrated in FIG. 1*b*, in which the longitudinal direction of members 104 and 112 is substantially parallel (or anti-parallel), In the configuration illustrated in FIG. 1*a*, easel 100 is also provided with flexible rear member 120 and cross-members 118, 122, and 128, which stabilize members 102, 104, and 112 and drawing support surface 108. A tray or bin 124 is also provided to house crayons, paints, or other drawing instruments. Bottom receptacle 126 is supported by cross-members 128.

In one configuration of the present invention, easel 100 is configured to collapse from the operable state of FIG. 1*a* to the portable state of FIG. 1*b* by performing one or more convenient operations. For example, if roll 110 is removed, easel 100 might be collapsed in the manner of an umbrella stroller. In the example shown in FIGS. 1*a* and 1*b*, easel 100 collapses by rotating lower support members 102 forward around support hinges 117 to fold against drawing surface support members 112, while also rotating rear support members 104 forward around support hinges 116 to fold against drawing surface support members 112. At the same time, members 118, 120, 122, and 128 collapse laterally to bring each of the opposing sets of members 102, 104, and 112 together, such that all of the members are roughly parallel to each other in a bundle, as shown in FIG. 1*b*. As one of ordinary skill in the art would appreciate, other collapsible support structures could be used, as have been implemented in, for example, collapsible strollers.

An aspect of the present invention provides increased portability for an easel. Although, in an operable state, easel 100 may have dimensions equal to conventional drawing easels, in a portable state as illustrated in FIG. 1*b*, the overall height may be reduced by approximately one half, and the overall depth and width drastically reduced. For example, easel 100 can be several feet wide and deep in operable condition, and may stand above adult eye level, but can collapse to fit in case 130, which could extend only a few feet in length and be only several inches in diameter. As another example, the dimensions of easel 100 could be suitable for use on a tabletop, using suction cups for bases 106 to anchor the easel 100, and collapsing and fitting into an even smaller case 130.

Figure 2A:
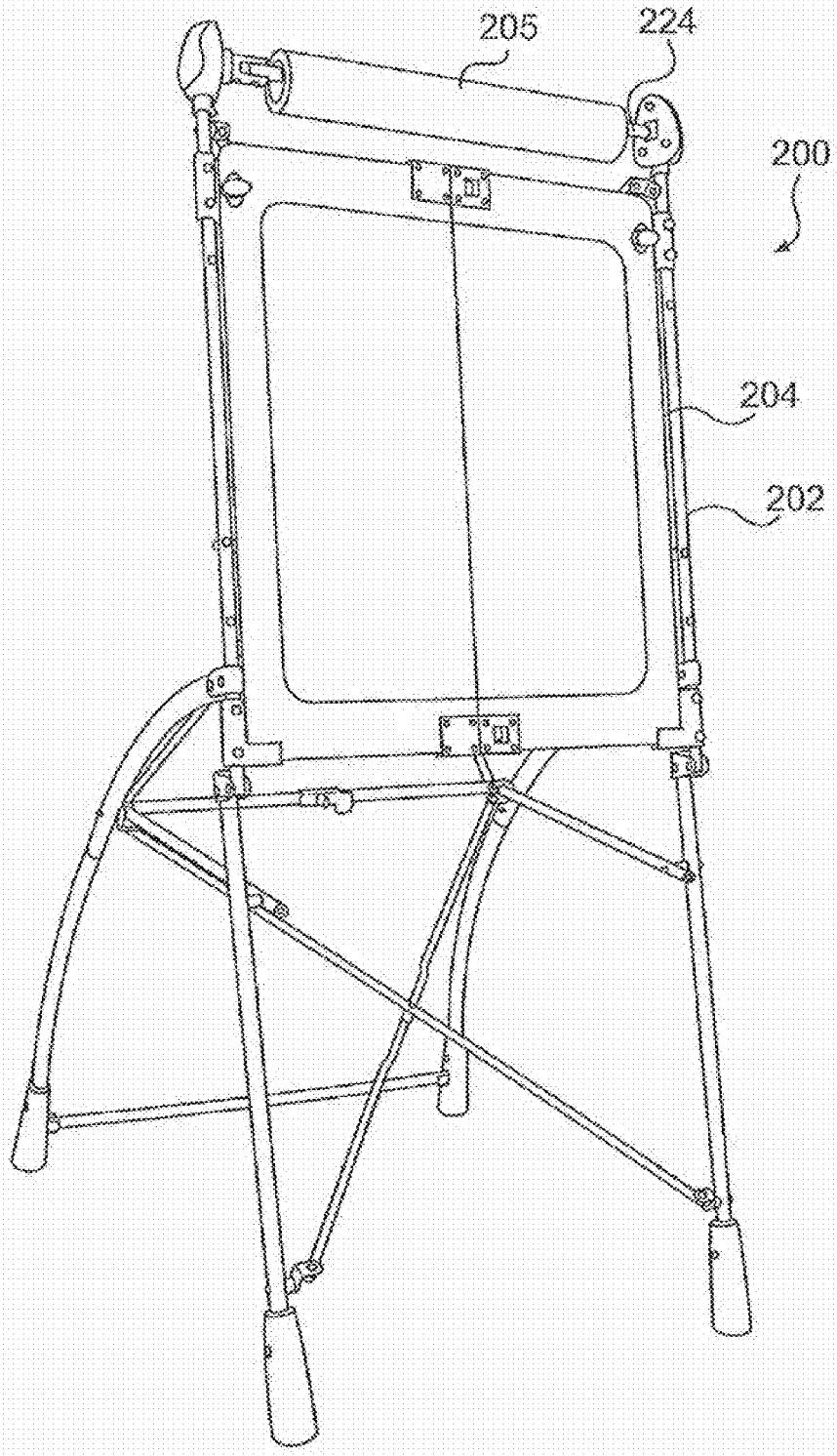
FIG. 2*a* is a schematic diagram that illustrates a front perspective view of a portable drawing apparatus, in accordance with additional embodiments of the present invention.
Figure 2B:
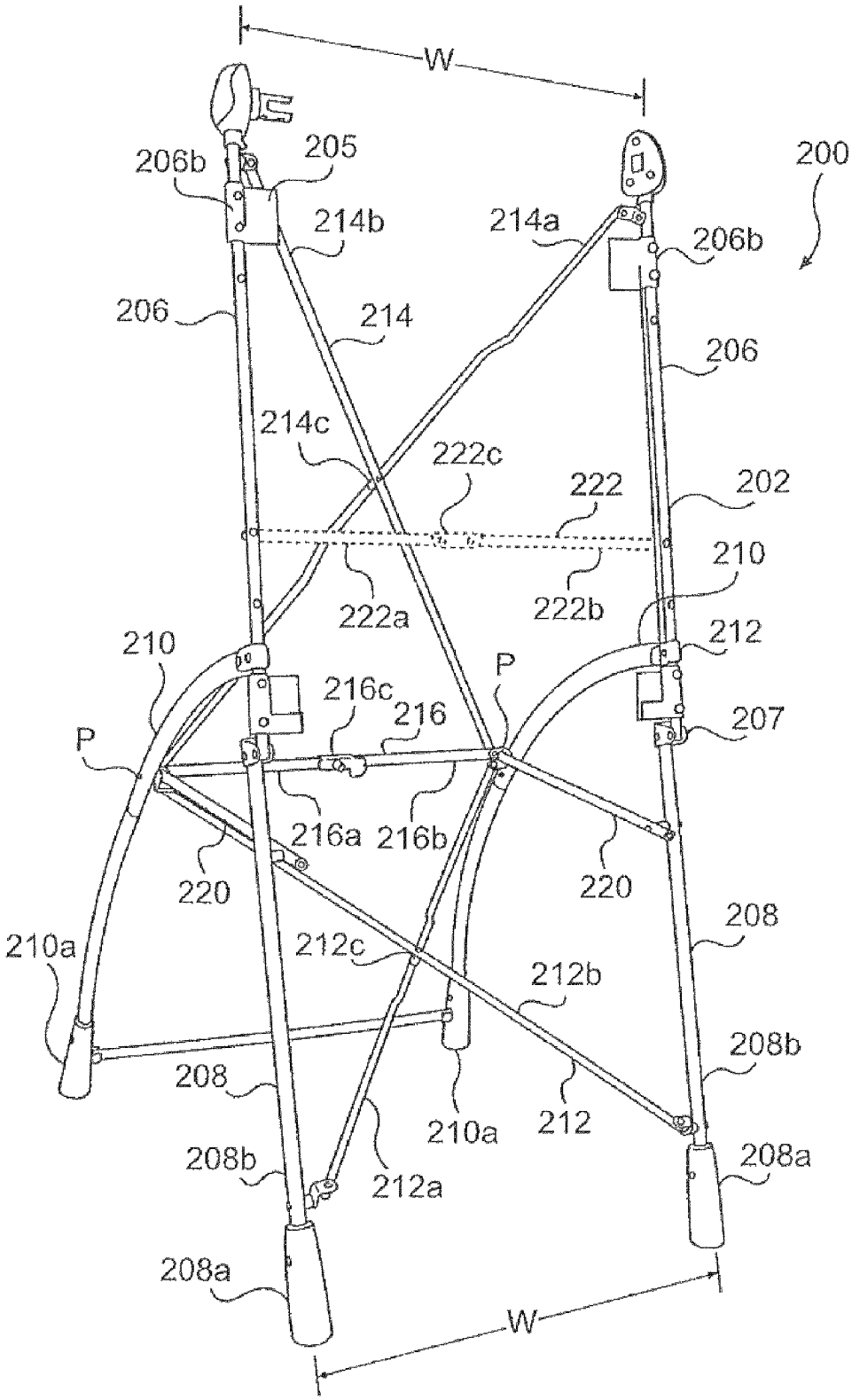
FIG. 2*b* is a schematic diagram that illustrates a front perspective view of a portable drawing apparatus frame, in accordance with additional embodiments of the present invention.
Figure 2C:
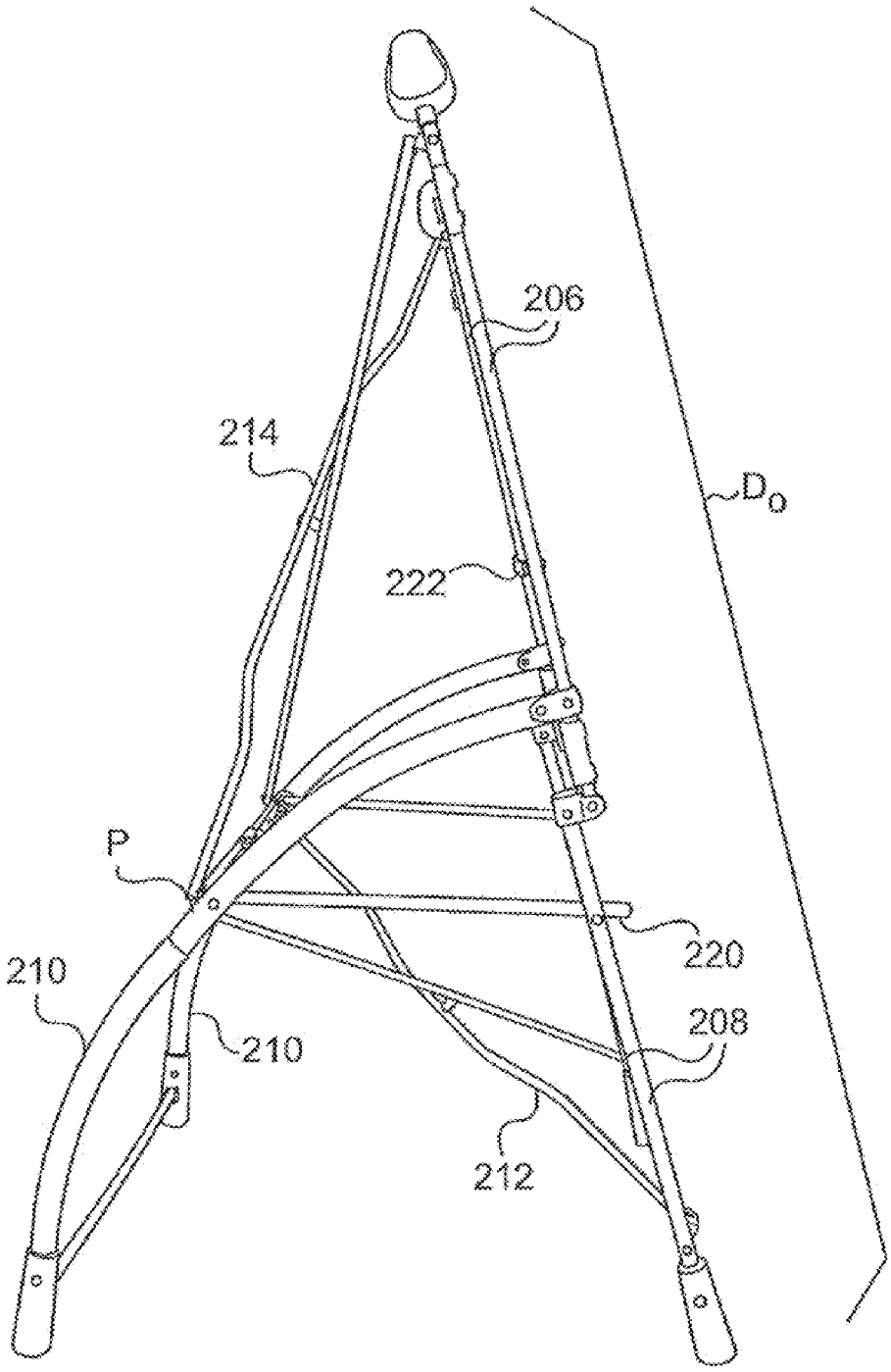
FIG. 2*c* is a schematic diagram that illustrates a side perspective view of a portable drawing apparatus frame, in accordance with additional embodiments of the present invention.

FIGS. 2*a*-2*c* illustrate further features of a portable easel 200, in accordance with additional embodiments of the present invention. FIG. 2*a* shows an exemplary portable easel 200 comprising an easel frame 202 and drawing support surface 204. Embodiments of the present invention include other easel accessories and means for reversibly attaching those accessories, as discussed further below. In some embodiments of the present invention, drawing support surface 204 can be used to draw upon directly, while in other embodiments, drawing support surface 204 may be used to support another drawing surface, such as paper dispensed from roll 205.

As noted above with respect to FIGS. 1*a* and 1*b*, in embodiments of the present invention, a drawing support surface, such as a collapsible fabric, may be integrated within an easel, such that the drawing support surface remains affixed to the easel frame whether the easel is in an operational configuration or in a collapsed configuration. In that case, the drawing support surface could be deemed part of the easel frame. However, in other embodiments of the present invention, the drawing support surface 204 is configured to easily attach and detach from easel frame 202. In such cases, drawing support surface 204 preferably is a rigid body that can be placed on frame 202 and thereby provide a rigid surface to support drawing, and provide further structural strength and rigidity to the overall frame 202 when the easel is in an operable configuration.

As depicted in FIG. 2*b*, which illustrates the operational configuration of an easel, easel frame 202 comprises a set of interconnecting members. The term "easel frame," as used herein, generally refers to a set of structural elements that are interconnected to provide support for a drawing surface to be placed at an elevated position on the easel. The term does not necessarily include, but may include, the drawing surface itself, or other accessories that may be detached from the easel and do not perform a primarily structural function.

Easel frame 202 includes upper support members 206, which are used to hold drawing support surface 204 at a convenient height for a user to draw upon. Upper support members 206 are also referred to as drawing support surface supports because members 206 can be configured to hold a drawing support surface in the configurations of the invention discussed herein. In the operational configuration shown in FIG. 2*b*, upper members 206 define an upwardly and rearwardly inclined plane upon which a drawing support surface can be placed. For example, connectors 205 can be positioned at four corners of upper support members 206 in order to connect to and hold a drawing support surface 204, as illustrated in FIG. 2*a*.

Each of the two upper support members 206 are pivotally connected to lower support members 208, and are substantially parallel to each other and the lower support members. In an alternative embodiment, an upper support member and its corresponding lower support member are coaxial. Lower support members 208 are configured to rest on a surface, such as a floor, using feet 208*a*, which may be a flat bottomed plastic or rubber material, a suction cup type of structure, wheels, casters, or any other suitable structure. In one implementation, feet 208*a* may comprise wheels or rollers that are preferably lockable.

In the embodiment illustrated in FIG. 2*b*, lower support members 208 are configured so as to pivot on hinges 207, wherein the distal ends 206*b* of upper support members 206 can be brought together with distal ends 208*b* of lower support members 208, as discussed further below. Although each lower support member 208 may be offset from a respective upper support member, such that they do not lie on the same line, preferably, each pair of upper and lower support members can be coplanar (that is, the pair lie in a common substantially planar surface) and lie in a plane that is substantially perpendicular to the plane defined by the upper support members 206. Thus, when viewed from the front, an upper support member 206 may appear to be collinear with a respective lower support member.

Easel frame 202 also includes rear members 210 that are pivotally connected to upper support members 206 and are directed downwardly and rearwardly from the plane defined by upper support members 206. In one embodiment of the present invention, in the operational configuration, each rear support member 210 connects to a respective upper support member 206 so that both lie in a substantially planar surface that is at an angle to (e.g., substantially perpendicular to) the inclined planar surface defined by upper support members 206.

In another embodiment of the present invention, as shown in FIG. 2*b*, rear support members 210 have a curved shape, wherein each rear support member 210 intersects a corresponding upper support member at about a ninety degree angle or at an angle that is somewhat less than ninety degrees, such as seventy five degrees or more. This curvature aids in the ability to collapse easel frame 202 into a compact bundle, as discussed further below. Additionally, in embodiments that provide curvature to the entire rear support member 210, the distal ends of rear support members 210 can also intersect a horizontal surface at about a seventy five to ninety degree angle, adding to the stability of feet 210*a*. The curvature of rear members 210 also decreases the depth of easel 200 in an operational configuration by reducing the rearward projection of rear support members 210, as compared to straight rear members that intersect a horizontal surface (e.g., a floor) at an acute angle. However, in other embodiments of the present invention, rear support members 210 may be less curved or substantially straight. In embodiments in which rear support members are substantially straight, the rear support members preferably extend at a substantial angle with respect to the plane of the upper support members, wherein the term "substantial angle" (as used herein) in the context of the rear support members denotes an angle greater than about thirty degrees.

In a preferred embodiment of the present invention, upper members 206, lower members 208, and rear members 210 all are hollow metal tubes, which thereby helps reduce the weight of easel frame 202 as compared to a frame having solid members.

Frame 202 also contains lower cross frame 212 and upper cross frame 214, which are connected to respective lower and upper support members 208 and 206. The cross frames provide support to the easel frame when in an operational configuration, and facilitate the reversible expansion and collapse of easel frame 202, as discussed further below.

Lower cross frame 212 comprises two elongated members 212*a* and 212*b*, which are pivotally connected to each other at pivot 212*c*, located at the approximate center of each member 212*a* and 212*b*. Accordingly, members 212*a* and 212*b* are configured so that their respective distal ends can approach each other or be spread apart, in a scissors-type action.

Similarly, upper cross frame 214 comprises two elongated members 214*a* and 214*b*, which are pivotally connected at their respective centers to each other using pivot 214*c*. Accordingly, members 214*a* and 2142*b* are configured so that their respective distal ends can approach each other or be spread apart, in a scissors-type action.

In one embodiment of the present invention, pivots 214*c* and 212*c* include cylindrical or similarly shaped standoffs that are each arranged between a respective cross frame couple 214*a*, 214*b* and couple 212*a*, 212*b*. The standoffs allow the members of each couple to pivot in a scissors action without undue friction that could be caused if metal members were adjacent to each other without a standoff.

In the embodiment illustrated in FIG. 2*b*, members 214*a* and 212*a* of respective upper and lower cross members 214 and 212 are each bent in the region of their respective pivots 214*c* and 212*c*. This facilitates the ability of the distal ends of member 214*a* (212*a*) to lie in a common plane with the distal ends of member 214*b* (212*b*), even though pivot 214*c* (212*c*) presents a standoff that displaces member 214*a* (212*a*) from the plane of member 214*b* (212*b*) in the region of the pivot.

The plane defined by lower cross frame 212 extends from the front of the frame 202 upwardly and towards the rear of easel frame 202 as viewed from the user side, while the plane defined by upper cross frame 214 extends from the rear of the frame 202 upwardly and towards the front of easel frame 202.

Easel frame 202 further includes hinged lateral member 216, which is connected on each end to a respective rear member 210. Hinged lateral member 216 comprises two portions 216*a* and 216*b*, which are joined at a common hinge 216*c* in a central region. Hinge 216*c* is preferably a one way locking hinge that can be of a known structure and is used to secure member 216 in a straight line when easel 202 is in an operational configuration. Hinge 216*c* can be configured so that it only opens in one direction. Hinged lateral member 216 serves to define the width W of easel frame 202 when easel frame 202 is in an operational configuration. To the extent that the materials and joints used to construct easel frame 202 are relatively rigid, the lateral distance between rear support members 210, which is approximately the same as the length of member 216, is also the lateral distance between upper support members 206 and between lower support members 208.

As depicted in FIG. 2*b*, hinged lateral member 216 is connected on each end to a respective rear lateral member 210. However, in other embodiments of the present invention, a single hinged lateral member 216 could extend between respective upper support members 206 or between lower support members 208. In addition, as described further below, an easel frame 202 arranged according to embodiments of the present invention could contain more than one hinged lateral member having approximately the same length and serving to define the width W of the easel.

Easel frame 202 optionally includes side lateral members 220, which are each pivotally connected on both ends to a respective rear support member 210 and lower support member 208. Side lateral members 220 are configured to add extra stability to easel frame 202. In an operational configuration, side lateral members 220 preferably form an angle of about minus fifteen degrees (arbitrarily defined as upwardly sloping from the easel front to the easel back in a side view) to plus fifteen degrees (downwardly sloping) with respect to a horizontal surface defined by the plane of feet 210*a* and 208*a*. In the exemplary configuration of the invention shown in FIG. 2*b*, hinged lateral member 216 represents a line that defines the intersection of the planes defined by lower cross frame 212 and upper cross frame 214. In this configuration, side lateral members 220 are also arranged to intersect hinged lateral member 216 at its endpoints. Accordingly, the endpoints of hinged lateral member 216 represent the intersection of five different members: 210, 212, 214, 216, and 220.

Hinges employed in embodiments of the present invention can be various known types. For example, the point P illustrated in FIG. 2*b* can include two L-shaped hinges that each accommodate rotation about two different axes, thereby allowing several different members to rotate about point P in several different directions.

In other configurations of the invention, the endpoints of member 216 can intersect rear support members 210 at points of intersection that are different from the points of intersection of side lateral members 220 with rear support members 210, the latter of which can also differ from points of intersection of upper and lower cross frames 206 and 208.

FIG. 2*c* depicts a side view of easel 202, arranged having substantially the same features as that depicted in FIG. 2*b*. As illustrated in this example, the plane of lower cross frame 212 extends rearwardly from the front of easel 202 at an angle of about forty five degrees with respect to the horizontal plane defined by the legs of rear support members 210 and lower support members 208. In embodiments of the present invention, this angle is preferably in the range of about thirty to sixty degrees. The plane of upper cross member 214 extends frontwardly from the intersection with the plane of lower cross member 212 at an angle of about seventy to seventy five degrees with respect to the horizontal plane defined by the legs of rear support members 210 and lower support members 208. In embodiments of the present invention, this angle is preferably in the range of about sixty to eighty five degrees.

By providing a line of intersection P (also referred to as a point P when considered from a side view) for planes of cross frames 212 and 214 that is located well above the lower extremities of easel frame 202, the compactness of a bundle formed from easel frame 202 can be improved, as described further below. In preferred embodiments of the present invention, the point P is about halfway or greater from the foot 210*a* to the point where rear member 210 intersects upper member 206.

Referring again to FIG. 2*b*, an optional front hinged lateral member 222 (represented by dashed lines) is depicted, comprising two portions 222*a* and 222*b* joined by a common hinge 222*c* located in a central portion. Front hinged lateral member 222 adds further stability to easel frame 202 and more directly defines the lateral spacing between upper members 208 than a configuration in which only hinged lateral member 216 is used to space rear support members 210. Later member 222 can also provide added support behind a drawing surface mounted on frame 202.

In another embodiment of the present invention, a lower lateral member (not shown) can be used to space rear members 210 near feet 210*a*.

Also depicted in FIG. 2*a* is optional top member 224, which is configured to connect to the distal ends of upper support members 206. Top member 224 can be configured as a cylinder or similar shape, and acts as a dispenser by being positionable within a hollow roll, such as roll 205, which may be a paper roll that can be used to write on when paper from the roll is drawn down upon drawing support surface 204. Top member 224 also adds stability to easel frame 202 by connecting opposed distal portions 206*b* of upper support members 206.

Figure 2D:
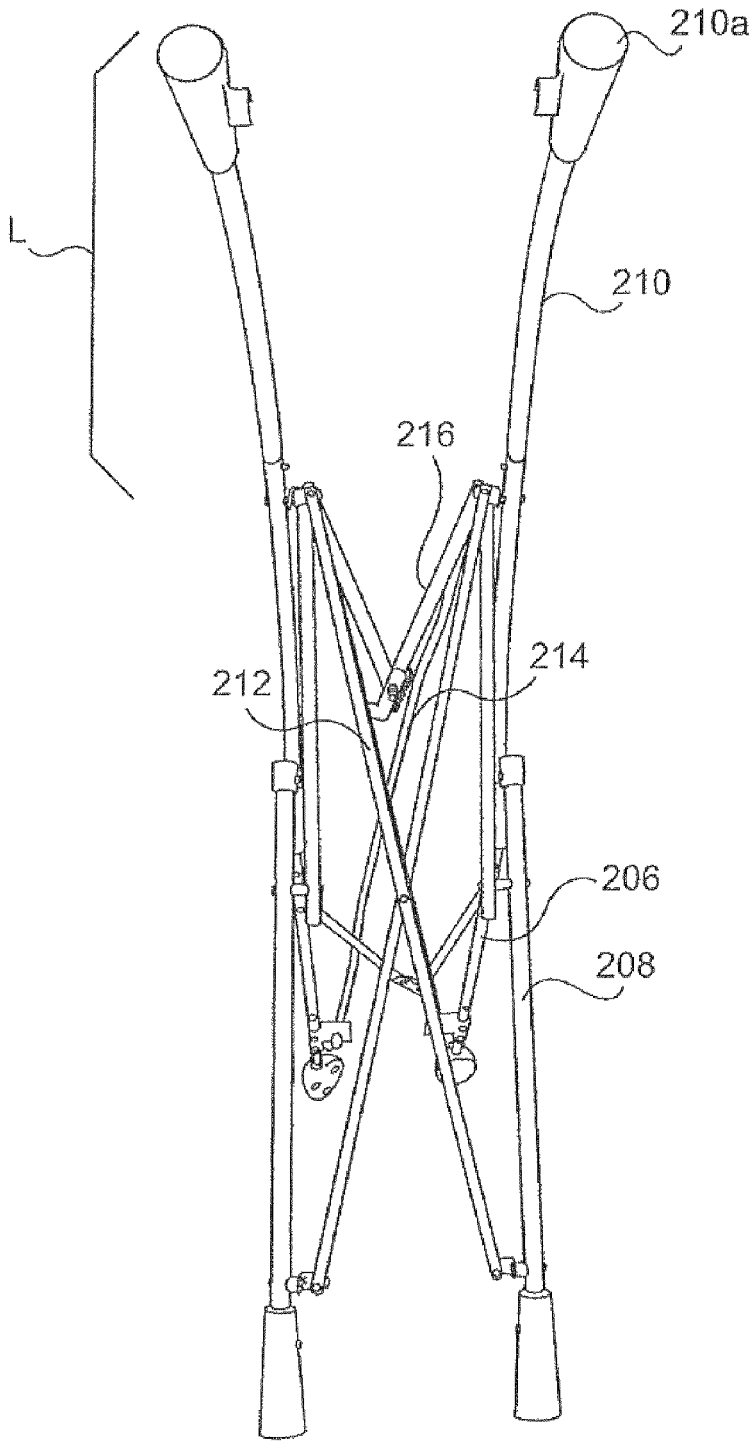
FIGS. 2*d* and 2*e* are schematic diagrams that illustrate a top view and side view, respectively, of a collapsed easel frame having a side lateral member, according to an embodiment of the present invention.
Figure 2E:
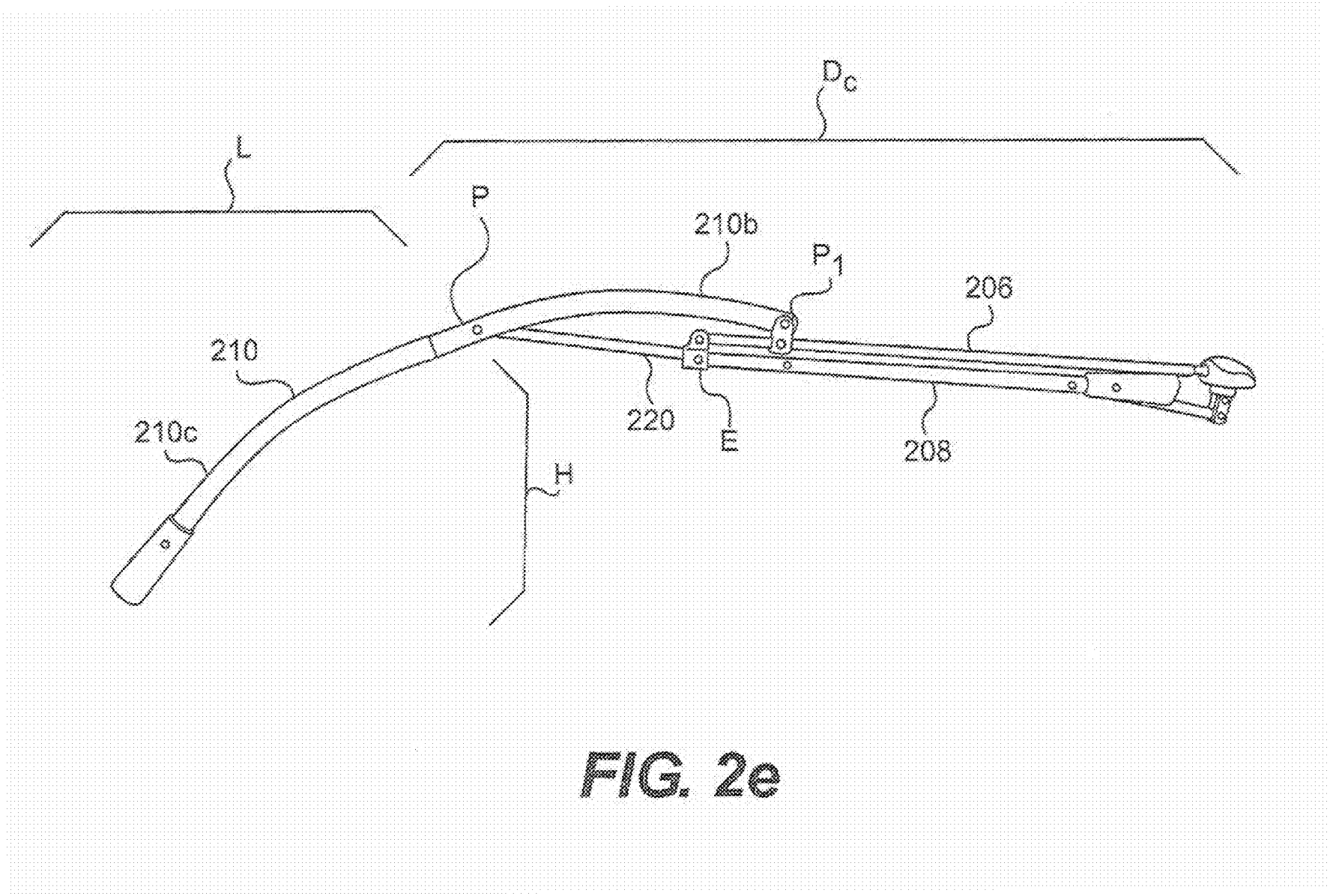

In accordance with embodiments of the present invention, easel frame 202, as substantially depicted in FIG. 2*b*, is configured to collapse into the structure shown in FIGS. 2*d* and 2*e*, which depicts easel frame 202 in a collapsed state. Using only one or a few steps (operations), frame 202 can be transformed into frame 202*a* illustrated in FIG. 2*d*. In embodiments of the present invention in which easel frame 202 does not include front hinged lateral member 222 or top member 224, easel frame 202 can be collapsed in a single step that involves unlocking hinge 216*c* and pulling hinge 216 upward, which causes members 216*a* and 216*b* to move upwardly in the region of hinge 216*c*. This motion forces rear support members 210 to move inwardly towards each other, which also causes the distal portions 214*a* and 214*b* of upper cross frame 214 to move towards each other. A similar movement occurs for distal portions 212*a* and 212*b* of lower cross member 212. These motions cause the "X" pattern of each of upper and lower cross members 214 and 212 to elongate and narrow, which forces the distal portions 208*b* of upper support members 208 to rotate towards the distal portions 206*b* of lower support members 206.

At the same time, rear support members 210 rotate inwardly toward upper support members 206, with the resultant configuration shown in FIGS. 2*d* and 2*e*. The above movements can be accomplished in one continuous motion, such that the collapse of easel frame 202*a* can be accomplished in the matter of a few seconds.

FIG. 2*d* illustrates a top view and FIG. 2*e* illustrates a side view of a collapsed easel frame 202*a* having a side lateral member 220. By providing curvature to rear support member 210, easel 202 can be collapsed so that the region of rear support member 210 near hinge point P1 can fold substantially parallel to upper support member 206 without striking hinge point E, even though it is also attached to side lateral member 220 at hinge point P.

Figure 2F:
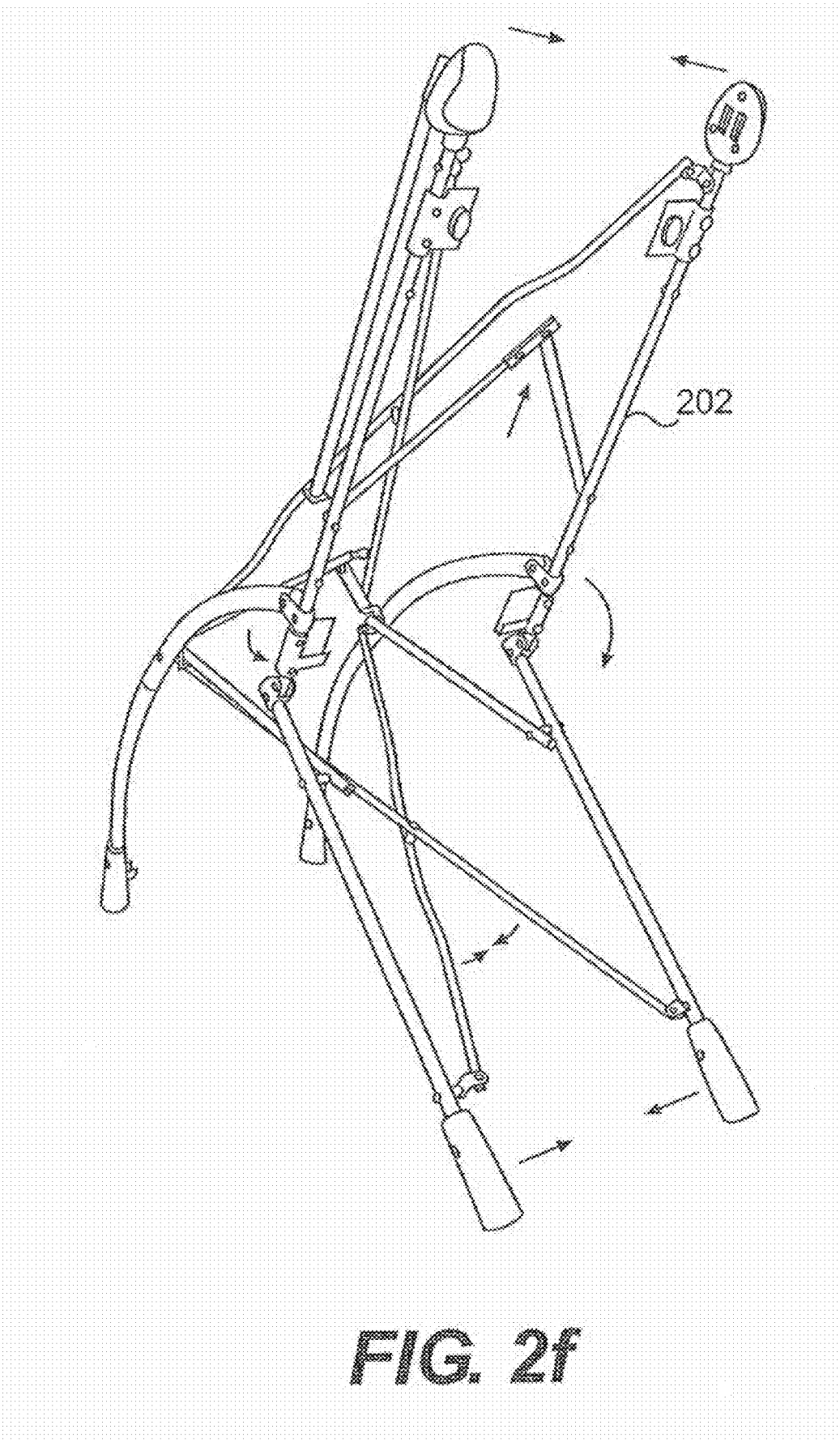
FIG. 2*f* is a schematic diagram that illustrates the relative motion of the various members of frame when collapse is initiated from the operational configuration, according to an embodiment of the present invention.

FIG. 2*f* is a schematic depiction of the relative motion (indicated by arrows) of the various members of frame 202 when collapse is initiated from the operational configuration. Upper support members 206 are configured to rotate with respect to lower support members 208, such that their respective distal ends can form an angle with respect to their common hinge of about one hundred eighty degrees to about zero degrees.

In configurations of the invention in which easel frame 202 includes front hinged lateral member 222, hinge 222*c* is also configured to be pulled upwardly along with hinge 216*c* in order to initiate collapsing of easel frame 202.

Figure 3A:
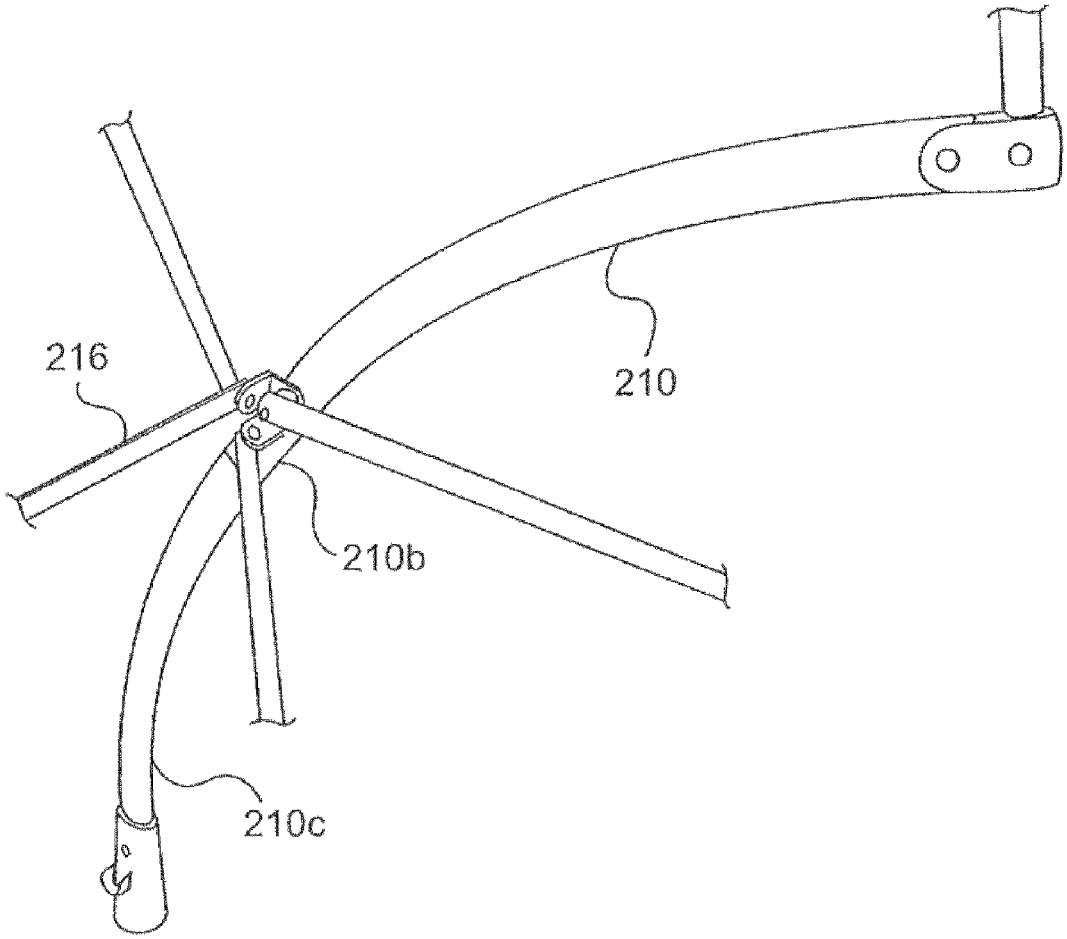
FIGS. 3*a* and 3*b* are schematic diagrams that illustrate a side perspective view and front view, respectively, of details of a rear support member, arranged in accordance with a further embodiment of the present invention.
Figure 3B:
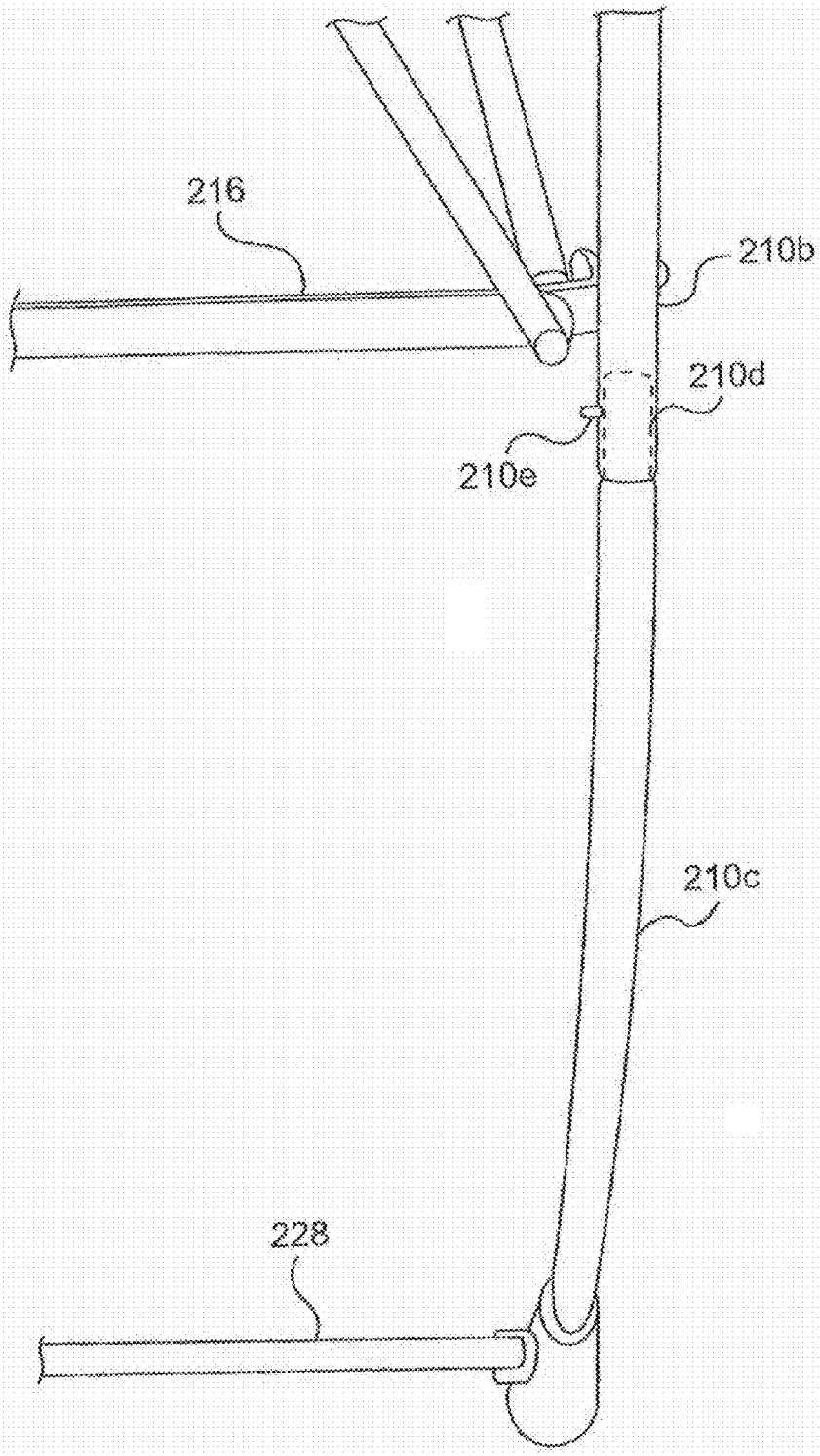

FIGS. 3*a* and 3*b* illustrate details of a rear support member 210, in accordance with a further embodiment of the present invention. Rear support member 210 comprises an upper section 210*b* and lower section 210*c*, the latter of which is removable from easel frame 202. For example, as illustrated in FIG. 3*b* (which is a partial view facing the rear of frame 202), lower portion 210*c* can be a member having a similar cross-sectional diameter as upper portion 210*b*, except for an upper sleeve portion 210*d* that is slightly smaller in cross-sectional dimension as compared to portion 210*b* (as well as the rest of lower portion 210*c*), such that lower portion 210*c* can fit within upper portion 210*b*. Lower portion 210*c* can be secured to upper portion 210*b* by means of a spring pin 210*e* located on the side of sleeve 210*d* and configured to extend through a hole (not shown) provided in upper portion 210*b*. However, other connection/release mechanisms are possible as would be apparent to one of ordinary skill.

By providing a means to conveniently remove the lower portion of rear support member 210, the overall length of easel frame for easy collapse 202 in the collapsed configuration can be reduced. In other words, referring again to FIGS. 2*c*, 2*d*, and 2*e*, embodiments of the present invention provide for a removable portion of rear support member 210 that could extend up to point P where member 210 intersects hinged lateral member 216, and where the planes of cross members 212 and 214 intersect. Thus, this embodiment provides a collapsible easel frame having upper and lower cross members permanently connected to the easel frame for easy collapse, while a significant portion of the length of the collapsed easel frame 202*a* can be removed, as designated by the dimension L. The remaining length of the collapsed bundle, $D_c$, is substantially less than the easel length, $D_o$, in operational configuration, as depicted in FIG. 2*c*. In embodiments of the present invention, removable portions 210*c* of rear support members are configured so that the collapsed bundle length is preferably substantially shorter than the operational easel length, wherein the term "substantially shorter" denotes at least about twenty percent shorter. For example, an adult sized easel having a six foot operational length could collapse into bundle of about a four to a four and half foot length.

In addition, the removal of the lower portion 210*c* of rear support member 210 serves to produce a bundle that is flatter in the case where member 210 is curved significantly, as illustrated in FIG. 2*e*, which shows that the bundle height can be reduced by an amount H when portion 210*c* is absent.

In another embodiment of the present invention, a two-part rear support member can be configured with a locking hinge that connects the top portion and lower portion. Referring again to FIG. 2*e*, the distal end of lower portion 210*c* can be configured to rotate towards member 208 when the easel is collapsed, so as to reduce the length of the collapsed bundle without necessitating removal of the lower portion 210*c*.

FIG. 3*b* also depicts a lower lateral member 228 that can extend between the lower regions of opposing rear support members 210. This member can add stability to the structure by maintaining the separation of rear members 210 at substantially the same distance provided by hinged lateral member 216, thus ensuring that the rear support members do not curve toward each other and that each continues to lie individually in a plane substantially perpendicular to the plane defined by the drawing support surface. The lower lateral member 228 must be removed before collapsing easel frame 202. Lower lateral member 228 can be arranged to engage a hole or slot provided in each rear support member 210. Although FIG. 3*b* depicts an embodiment in which lower lateral member 228 engages a removable portion 210*c* of a rear support member, other embodiments are possible in which the lower lateral member is used in conjunction with a rear support member having no removable portion. Optionally, lower lateral member 228 could be collapsible similarly to hinged lateral member 216.

Figure 4:
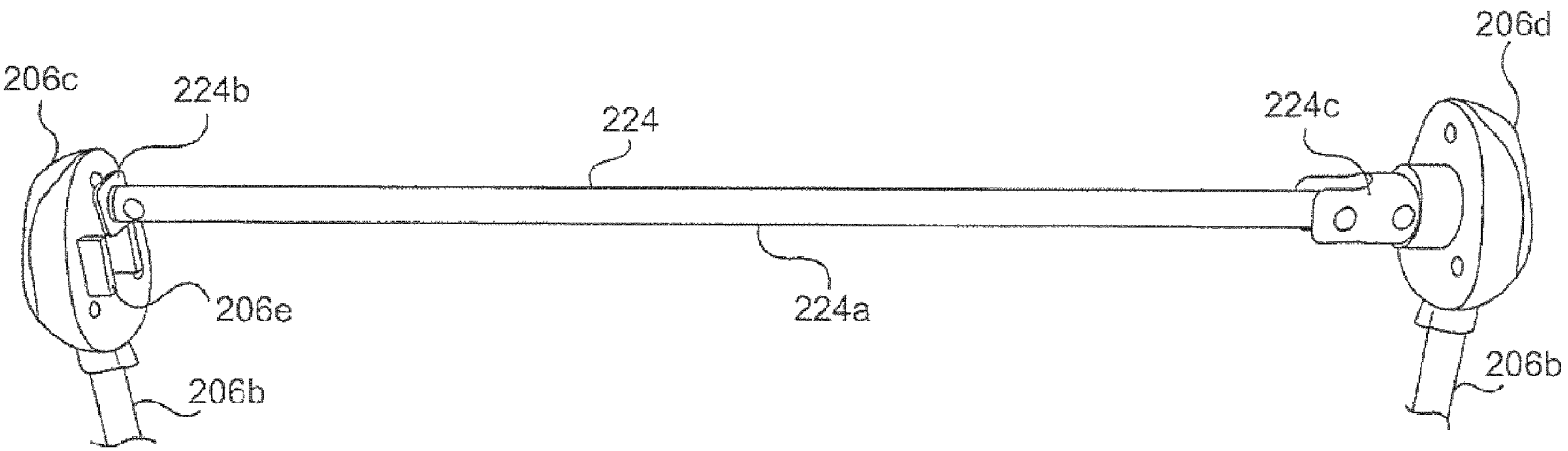
FIG. 4 is a schematic diagram that depicts details of a top member of a portable drawing apparatus, in accordance with another embodiment of the present invention.

FIG. 4 depicts an exemplary top member 224, arranged according to an embodiment of the present invention. Top member 224 extends between opposed cap regions 206*c*, 206*d* that are attached to respective upper support members 206. Top member 224 includes rod portion 224*a*, releasable end 224*b*, and rotatable end 224*c*. Top member 224 is configured to slide into mating region 206*e* provided on cap 206*c*. When removed from mating region 206*e*, top member 224 can rotate downwardly along a pivot provided on rotatable end 224*c* so that it extends parallel to upper support member region 206*b*. Thus, when it is desired to collapse an easel frame, end 224*b* can be released, which allows top member 224 to align in a bundle parallel with other members while remaining conveniently attached to the easel frame at end 224*c*. Preferably, top member rotatable end 224*c* also is configured to rotate around its axis that extends perpendicularly from cap 206*d*, so that rod 224*a* can rotate along its axis as necessary to align its releasable end 224*b* with a mating region 206*e*. In addition, cap 206*d* can be configured to swivel, so that rod 224*a* can be used as a drawing roll pin that can be conveniently swiveled away from releasable end 224*b* for loading and unloading paper drawing rolls.

In other configurations of the present invention, a top member 224 can be configured to release on both ends.

Figure 5A:
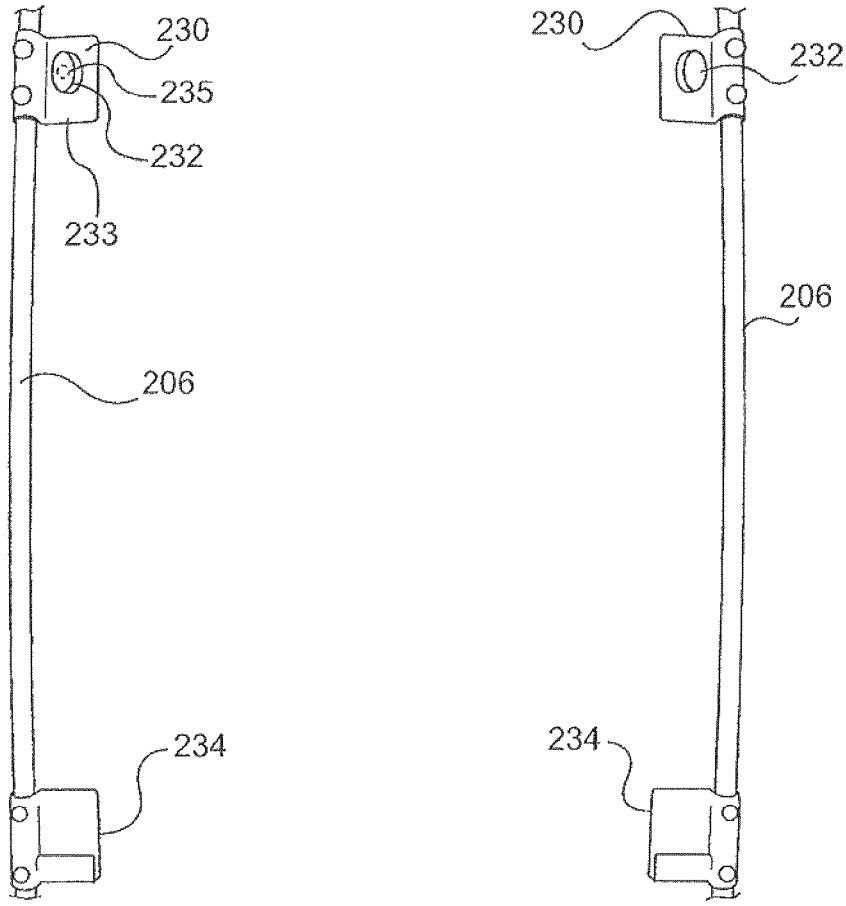
FIGS. 5*a*-5*c* are schematic diagrams that illustrate a front view of details of drawing support surface connectors, as well as a drawing support surface in accordance with an embodiment of the present invention.
Figure 5B:
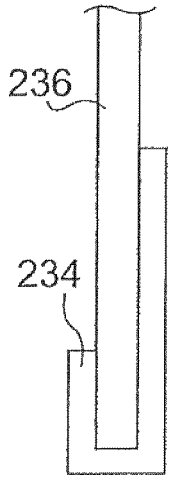
Figure 5C:
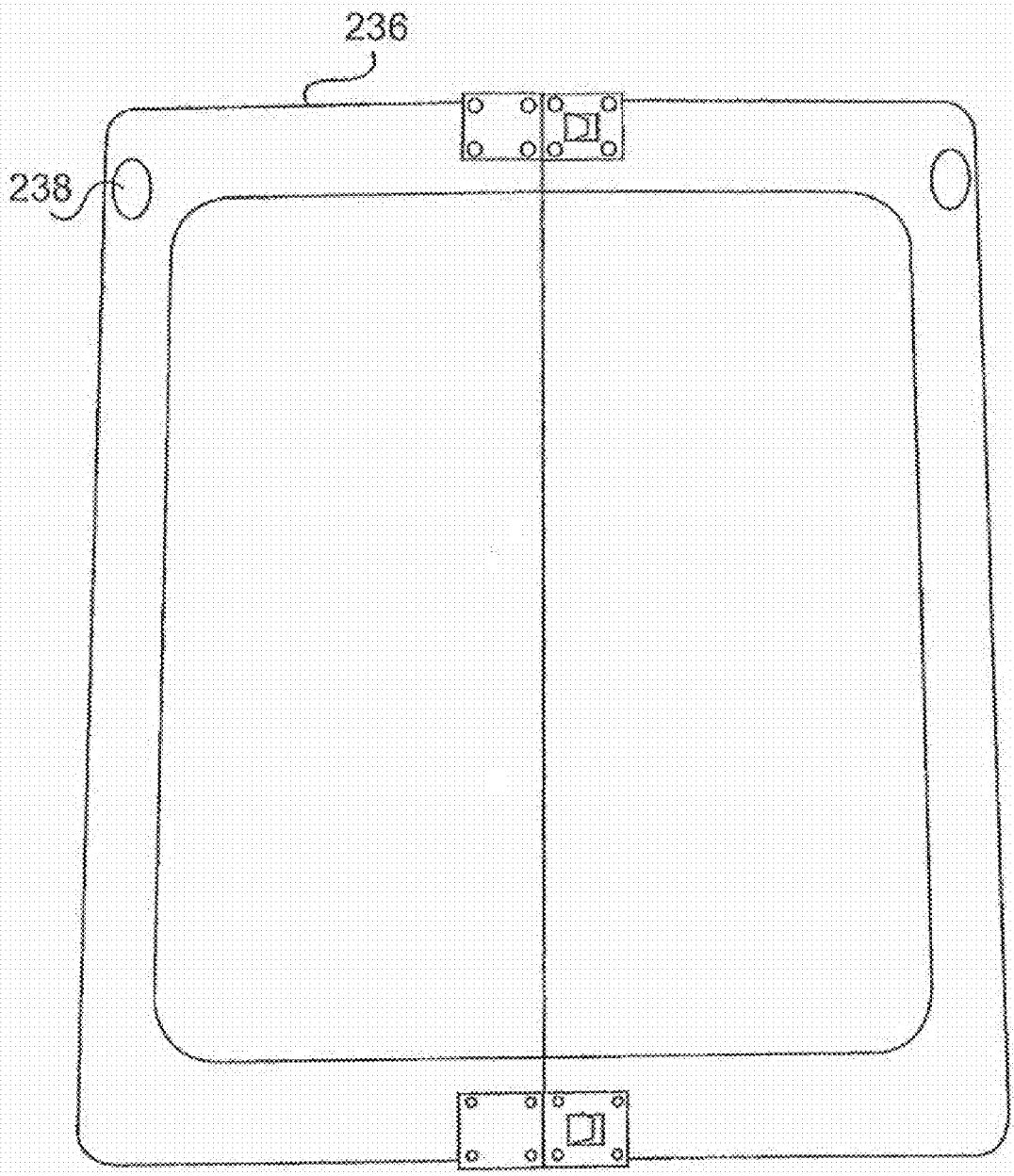

FIGS. 5*a*-5*c* depict details of drawing support surface connectors, in accordance with an embodiment of the present invention. Each upper support member 206 is provided with an upper connector 230 and lower connector 234. In the embodiment shown in FIG. 5*a*, upper connector 230 includes an oblong-shaped head 232 that lies in a plane above a plate 233. Head 232 is rotatable about a shaft 235 of smaller dimension, as shown. FIG. 5*c* depicts a drawing support surface 236, such as a dry erase board, that provides oblong holes 238 that match head 232. The board 236 can then be placed against surfaces 233 by arranging the holes 238 to align with heads 232 when the long direction of heads 232 is parallel to the long direction of holes 238. Heads 232 can be configured to stand off from surface 233 a sufficient distance to accommodate the thickness of board 236. Heads 232 can then be rotated to lock board 236 in place.

As depicted in FIG. 5*b*, lower connectors 234 can be U-shaped slots configured to accommodate and hold a board place in the slots from the top. However, many other connector designs are possible as will be apparent to one of ordinary skill. In addition, in other embodiments of the present invention, a drawing support surface could be affixed to members 206 using only a set of upper connectors 236, or only a set of lower connectors 234.

In one embodiment of the present invention, a rigid support surface such as board 236 can be provided as two halves that can be reversibly attached along a vertical border that lies in the approximate middle of the board when assembled. Accordingly, when disassembled, the board halves can be stored in a narrow carry bag whose narrow dimension only need be about half the width of the assembled board 236.

In one embodiment of the present invention, board 236 is configured to rest against front hinged member 222 for extra support. In embodiments of the invention in which no front hinged member 222 exists, board 236 can act to increase rigidity of frame 202 (see FIG. 2*a*). Although frames having no front hinged member 222, it may be preferable that board 236 be a unitary piece. However, in accordance with other embodiments of the present invention, two board halves can be joined using a coupler that provides a relatively rigid connection between boards, such as the tab and slot connection illustrated in FIG. 5*c*.

Figure 6:
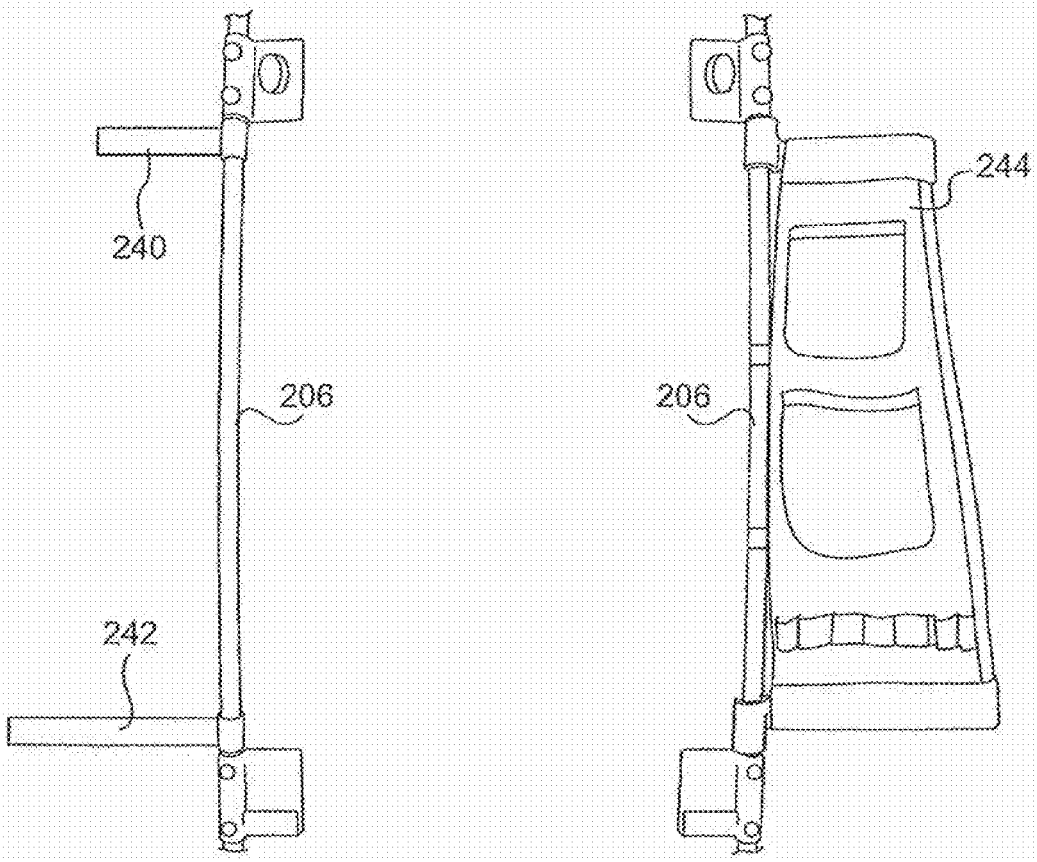
FIG. 6 is a schematic diagram that illustrates a front view of details of a set of side connectors arranged according to other embodiments of the present invention.

FIG. 6 depicts details of a set of side connectors arranged according to other embodiments of the present invention. In one embodiment, side connectors 240 and 242 can both be ruler-shaped extensions that can fit into openings provided in a side pouch 244 so as to attach side pouch 244 to upper support member 206. In the operational configuration, one or more side pouches are thus conveniently located on the side of a drawing support surface for easy access during easel use. The side pouch 244 can be used to hold markers or other drawing supplies. Connectors 240 and 242 are preferably configured to rotate about member 206 so that the connectors and pouches, can remain attached, and be rotated inwardly when easel 202 is collapsed. For example, connectors 240, 242 can include a flexible ring-shaped end with an open slot in the ring (e.g.; a C-clamp) that provides for reversible clamping to shaft 206. The relative length of connectors 240, 242 can be arranged according to the dimensions and shape of a pouch to be attached.

Figure 7:
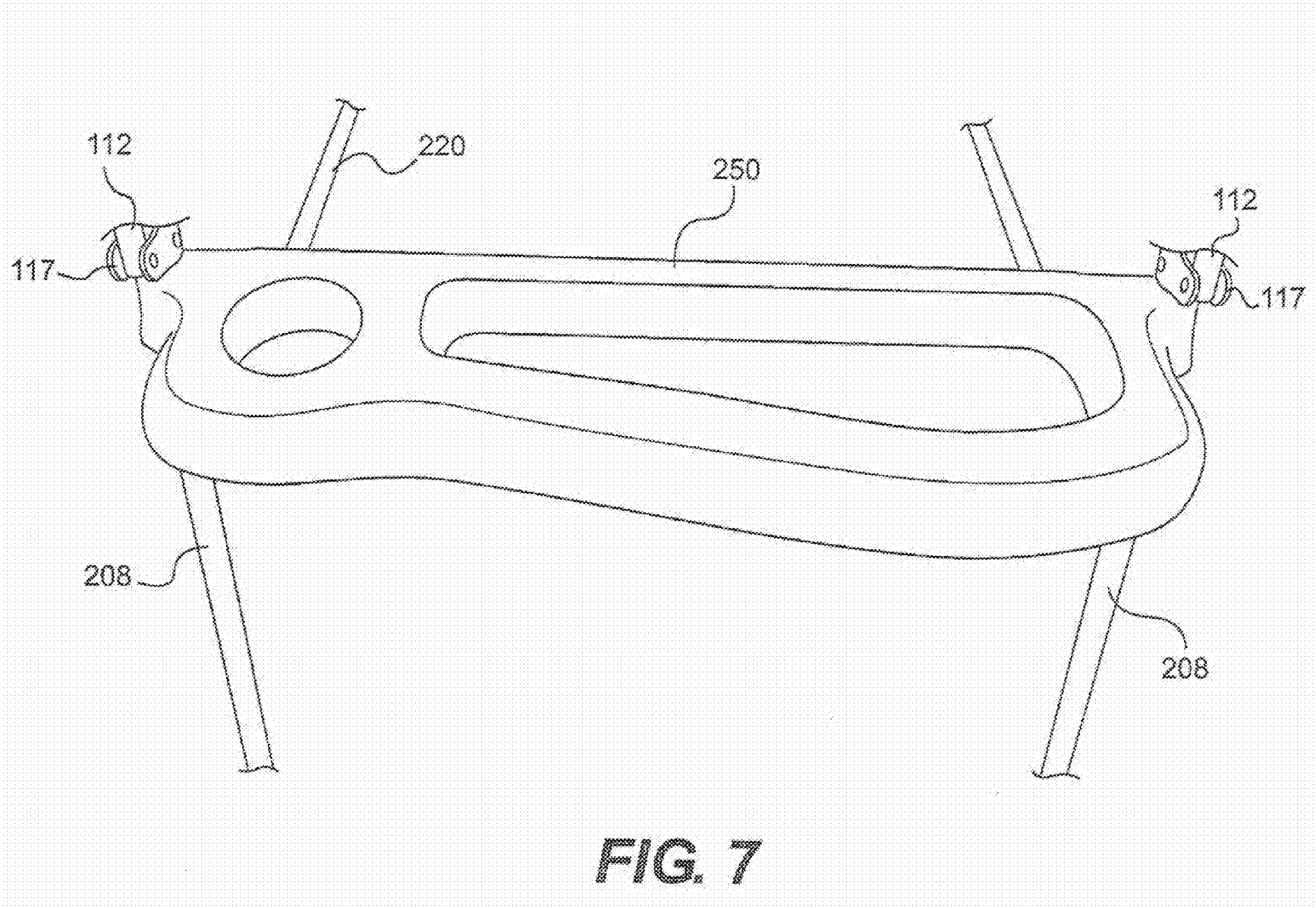
FIG. 7 is a schematic diagram that illustrates a front perspective view of details of a front tray arranged in accordance with a further embodiment of the present invention.

FIG. 7 illustrates details of a front tray 250 arranged in accordance with a further embodiment of the present invention. Tray 250 can be used to hold, for example, paints, water, sponges, and the like. In one embodiment of the invention, tray 250 is configured to snap onto members 208 and is prevented from sliding down shafts 208 by lateral members 220, which are arranged to protrude in front of shafts 208, and thereby to extend under tray 250 when in place. Optionally, instead of or in addition to a tray, a bin could be used.

Referring again to FIGS. 1*a* and 2*a*, in other embodiments of the present invention, a soft compartment, such as compartment 126 shown in FIG. 1*a*, can be provided that can be attached to frame 202 as to occupy a region bounded on the lower side by cross frame 202 and on the upper side by side lateral members 220. The soft compartment is provided with an opening in the front of the easel for easy access to store accessories. The soft compartment can be attached to the easel frame by various known methods, such as using Velcro strips, providing sleeves to go around the frame members, etc.

Figure 8B:
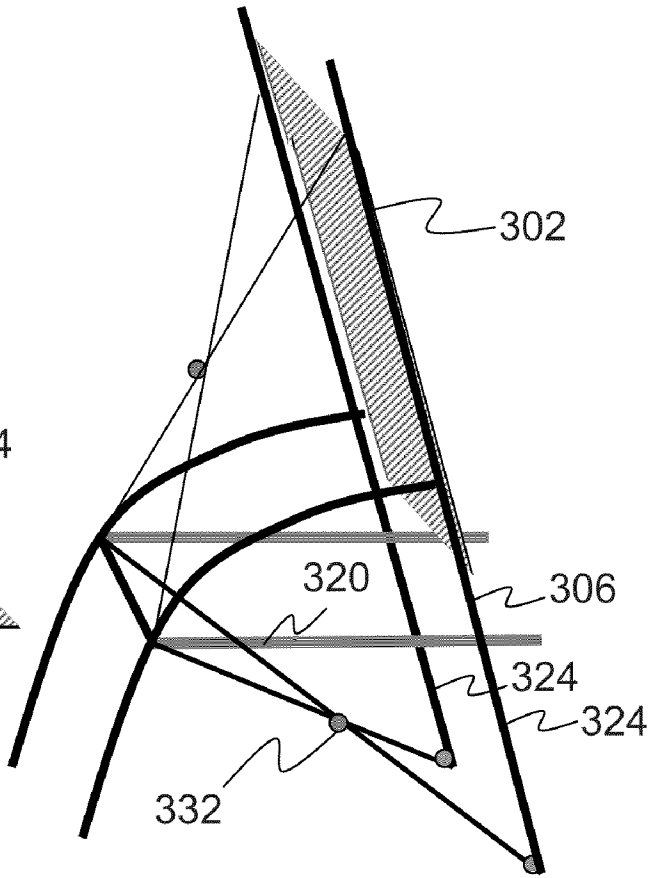
FIGS. 8*a*-8*c* are schematic diagrams that illustrate side perspective views of the operation of a portable drawing apparatus that provides a desk surface, according to another embodiment of the present invention.
Figure 8A:
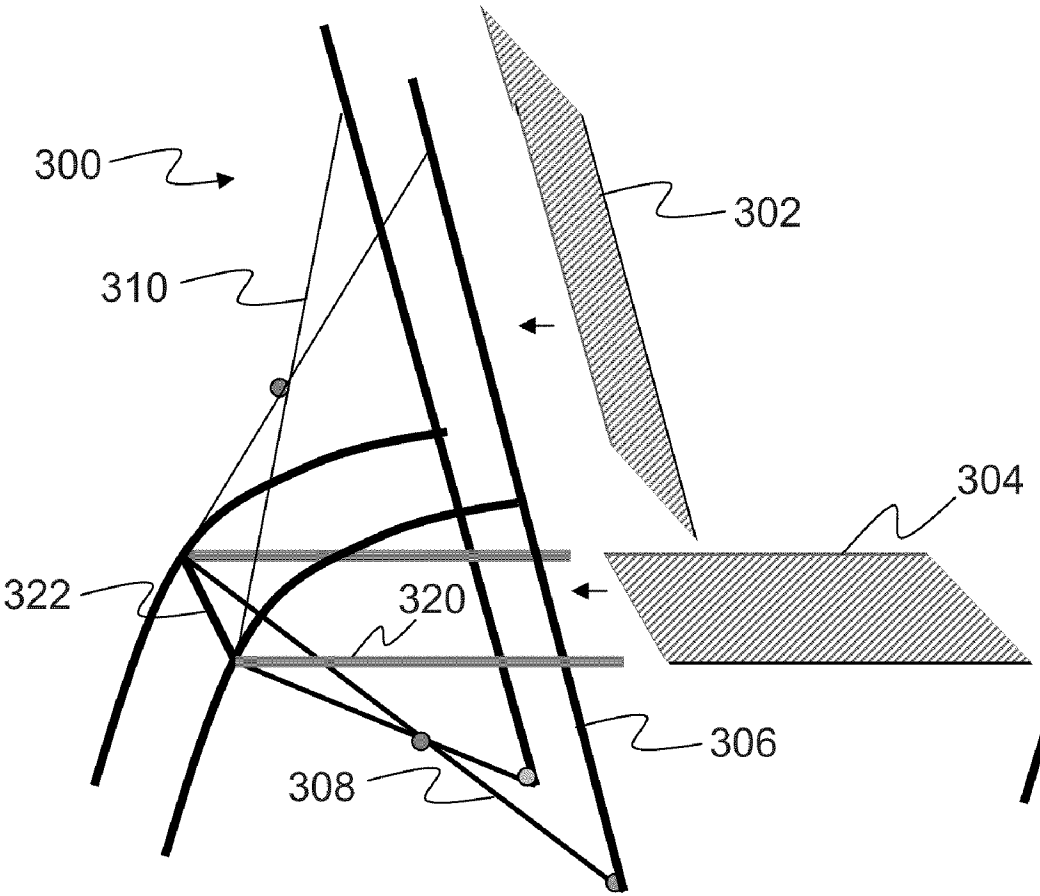
Figure 8C:
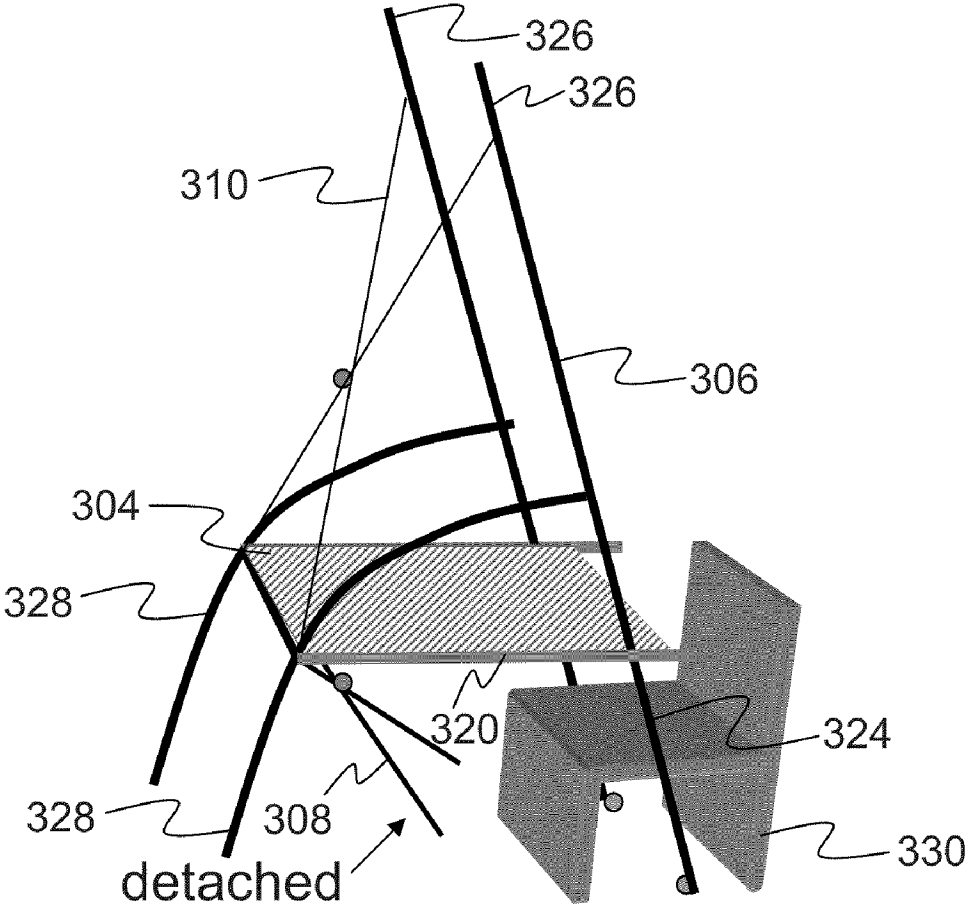

FIGS. 8*a*-8*c* depict perspective views of a portable drawing apparatus 300 arranged in accordance with another embodiment of the present invention. FIG. 8*a* illustrates that apparatus 300 can receive detachable drawing support surfaces 302 and 304. In one embodiment of the present invention, support surfaces 302 and 304 are the same object, which can be interchangeably used as an easel-type surface in configuration 302 or a desk/table-type surface in configuration 304. However, in other embodiments of the present invention, support surfaces 302 and 304 are separate objects that are tailored specifically as respective easel-type and desk-type surfaces.

Frame 306 of portable drawing apparatus 300 is preferably configured to collapse into a bundle in substantially the same fashion as portable easel 200 described above, with respect to FIGS. 2*b*-2*e*. For example, lower cross-frames 308 and upper cross-frame 310 are provided to facilitate collapse of frame 306. Preferably, the cross-frames act substantially in the same manner as cross-frames 212 and 214 described above. In the operational configuration of apparatus 300 depicted in FIGS. 8*a*-8*c*, except as specifically noted below, frame 306 preferably contains substantially the same elements as those depicted in frame 202 discussed above.

As discussed further below, apparatus 300 provides a desk/table/easel combination that is easy to set-up, as well as disassemble, and is easy to store and carry.

FIG. 8*b* depicts the use of portable drawing apparatus 300 as an easel. Support surface 302 can be a rigid board that is attached to frame 306 in accordance with procedures discussed above, for example, with respect to FIGS. 2*a* and 5*a*-5*c*. Board 302 could be a single piece or comprise two separate pieces as discussed above with respect to FIGS. 5*a*-5*c*.

FIG. 8*c* depicts the use of portable drawing apparatus 300 as a desk/table-type apparatus, in which support surface 304 is substantially horizontal. In the configuration shown, support surface 304 can be a single rigid board, or a board comprising two reversibly mutually attachable halves that can be detached for more compact storage.

As described in more detail below, in various embodiments of the present invention, apparatus 300 is configured to retain and support a substantially horizontal support surface 304, which is preferably a rectangular or square shape in plan view. The support surface 304 lies in a region bounded by the rear hinged member 322 in the back, and bounded by the "sides" of the frame, which are defined herein as a plane in which a respective rear member 328 and corresponding lower support member 324 each substantially lie. In embodiments of the invention in which lateral support members 320 are included, the side boundaries of support surface 304 can correspond substantially to the lines defined by each lateral support member 320. In the front, the front boundary of the support surface 304 is preferably configured so that it lies parallel to a line joining opposed lower support members 324. The front boundary of support surface 304 may protrude slightly in front of the plane defined by support members 324, as depicted in FIG. 8*c*. As also depicted in FIG. 8*c*, support surface 304 is configured to be disposed within frame 304 at a height convenient for a seated person to write or perform other tasks upon.

The term "retain a substantially horizontal support surface" refers to the fact that frame 306 can accommodate a support surface that rests upon members within the frame without other means of attachment, or is attached to members of frame 306, or both.

In one embodiment of the present invention, support surface 304 is configured to rest upon side supports 320 and optionally on hinged member 322, which performs a similar function as hinged member 216 described above. Support surface 304 need not thereby attach to any components of frame 306, while still providing a desk-type surface that can be used, for example, for writing, painting, or other desk or tabletop activities.

In another embodiment of the present invention, support surface 304 is configured to attach to any combination of side support members 320, rear hinged lateral member 322, rear support members 328, and lower support members 324. Attachment can be performed by any convenient known means, including Velcro connections, clips, ring damps, sleeves, knobs, etc. Attachment means can be provided on support surface 304, frame 306 or both.

In still another embodiment of the present invention, side supports 320 are absent from frame 306 and support surface 304 is configured to attach to at least one of rear hinged lateral member 322 and rear support members 328, in addition to being configured to attach to lower support members 324. Accordingly, in this embodiment, the presence of a horizontal support surface 304 provides mechanical stability to frame 306 in lieu of side support members 320. In this embodiment, an optional front hinged member (not shown) may be, but need not be present between upper supports 326.

In the configuration shown in FIGS. 8*a*-8*c*, frame 306 includes no front hinged member similar to member 222 shown above in FIG. 2*a*. However, in order to provide further stability to frame 306, in other embodiments of the present invention, a front hinged lateral member similar in structure and function as member 222 can be provided between upper support members 326, preferably at a sufficient height so as not to interfere with a user seated on seat 330. Optionally, a front hinged lateral member could be detachable on ones side or entirely removable, to give the user the option to detach it and collapse or swing it out of the way, or completely remove it.

In addition, a top member (not shown), similar to top member 224 described above, could be provided between upper support members 326 to provide additional stability.

By providing a rigid horizontal surface between opposing pairs of upper and lower support members 326 and 324, respectively, a support surface 304 can additionally act to increase the stability of frame 306.

In one embodiment of the present invention, the two frontward ends of lower cross-frame 308 are configured to be reversibly detachable from (or reversibly connectable to) lower support members 324, as illustrated in FIG. 8*c*. In this manner, a user seated as chair 330 is provided with additional legroom under support surface 304. However, in other embodiments of the invention, lower cross-frame 308 need not be detachable from members 324. The detachment/attachment of the ends of cross-frame 308 to members 324 can be accomplished by any convenient known means.

In order to provide for folding of cross-frame 308 after detachment from front members 324, in embodiments of the present invention lower cross-frame pivot 332 (see FIG. 8*b*) is a removable or, alternatively, a slidable pivot. As a removable pivot (not shown) pivot 332 could be clipped in and out similar to the action of a ball joint. Alternatively, a pivot comprising a hole and Christmas tree post type structure could be employed, in which the post compresses to go through the hole for connection and is squeezed to be removed back through the hole.

As a slidable pivot, pivot 332 could comprise two cylindrical sleeves that are mutually attached and are each configured to fit over a different respective member of the cross-frame 308. The two sleeves are mutually rotatable about a common pivot so that the angle between the sleeves can vary as the cross-frame 208 is folded in a scissors action to move away from the front of the frame 306, as shown in FIG. 8*c*. The sleeves are also untethered to the cross frame so that the pivot point can move as the frame is folded or unfolded.

In embodiments of the present invention in which lower cross-frame 308 is semi-detachable from frame 306 in the front of frame 306, the operation could proceed as follows. In collapsed configuration, frame 306 would be substantially similar to that of frame 202. To place frame 306 in operational configuration, a user would unfold the collapsed frame and lock rear lateral hinge member 322 to produce the structure substantially as shown in FIG. 8*a*. The attached cross-frames 308 and 310 would facilitate the unfolding and separation of other structural members of frame 306. When frame 306 is in operational configuration, a user could place an easel-type support surface 302 on frame 306 by attaching the support surface to upper support members 326, substantially as described above with respect to FIG. 2*a* and FIGS. 5*a*-5*c*, for example.

Alternatively, the user could attach support surface 304 to frame 306 or rest the support surface on portions of frame 306, as described above. If further desired, the user could then detach cross-frame 308 in the front and move the cross-frame back out of the way of a user to be seated at chair 330.

When done using desk surface 304, the user could remove the desk surface, reattach the front of cross-frame 308 to frame 306, and then perform a one-step collapse of frame 306, as described above with respect to FIGS. 2*c*-2*e*.

Accordingly, embodiments of the present invention, provide a semi-detachable cross-frame that provides a convenient means for setting up, storing, and transporting a drawing support apparatus that can be conveniently used as an easel or alternatively as a desk/table.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure.

For example, although the embodiments disclosed above depict a rear support member that is connected to an upper support member, embodiments of the present invention are contemplated in which a collapsible easel is configured with a rear support member connected to a lower support member. In the latter case, in order to provide collapsibility in the manner illustrated in FIGS. 2*d* and 2*e*, no side lateral member 220 would be included.

Furthermore, embodiments of the present invention are possible in which the lower cross frame is substantially horizontal, wherein the upper and lower cross frame planes meet in a line that is close to the foot 210*a* of a rear support member. In these embodiments, the rear support members are preferably substantially straight so that the rear support members can rotate to become parallel to the upper and lower support members in order that the height H (see FIG. 2*e*) of the collapsed bundle is minimized.

In addition, upper support members, lower support members, and rear support members can all be made from solid rods as opposed to hollow tubes.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible.

What is claimed is:

1. A portable drawing apparatus comprising:

a first and second drawing surface support member, wherein each of the first and second drawing surface support members has a first end portion and a second end portion opposite to the first end portion, wherein the first and second drawing surface support members laterally oppose each other, and wherein the first and second drawing surface support members are configured to connect to a drawing support surface;

a first and second lower support member, wherein each of the first and second lower support members has a first end portion and a second end portion opposite to the first end portion, wherein the first and second lower support members laterally oppose each other, and wherein the first end portion of the first lower support member is pivotally connected to the first end portion of the first drawing surface support member and the first end portion of the second lower support member is pivotally connected to the first end portion of the second drawing surface support member;

a first and second rear support member, wherein each of the first and second rear support members has a first end portion and a second end portion opposite to the first end portion, wherein the first and second rear support members laterally oppose each other, wherein the first end portion of the first rear support member is pivotally connected to one of the first drawing surface support member and the first lower support member, and wherein the first end portion of the second rear support member is pivotally connected to one of the second drawing surface support member and the second lower support member;

a cross frame having first and second cross frame members, wherein each of the first and second cross frame members has a first end portion, an intermediate portion, and a second end portion opposite to the first end portion, wherein the first and second cross frame members are pivotally connected to each other at their intermediate portions, wherein the first end portion of the first cross frame member is connected to the first rear support member, wherein the first end portion of the second cross frame member is connected to the second rear support member, wherein the second end portion of the first cross frame member is connected to one of the second drawing surface support member and the second lower support member, and wherein the second end portion of the second cross frame member is connected to one of the first drawing surface support member and the first lower support member;

wherein, in an operational configuration:

the first and second drawing surface support members are spaced apart and laterally oppose each other, and are configured to connect to the drawing support surface and hold the drawing support surface between the first and second drawing surface support members, the second end portion of the first lower support member is pivoted away from the first drawing surface support member, the second end portion of the second lower support member is pivoted away from the second drawing surface support member, the first rear support member extends at an angle with respect to the one of the first drawing surface support member and the first lower support member, the second rear support member extends at angle with respect to the one of the second drawing surface support member and the second lower support member, and the second end portion of the first rear support member, the second end portion of the second rear support member, the second end portion of the first lower support member, and the second end portion of the second lower support member are configured to rest on a planar surface, and wherein, in a collapsed configuration, the first drawing surface support member and the first lower support member are pivoted closed, with the second end portion of the first drawing surface support member adjacent to the second end portion of the first lower support member, the second drawing surface support member and the second lower support member are pivoted closed, with the second end portion of the second drawing surface support member adjacent to the second end portion of the second lower support member, the first end portion of the first cross frame member and the first end portion of the second cross frame member are closer to each other than when in the operational configuration, the second end portion of the first cross frame member and the second end portion of the second cross frame member are closer to each other than when in the operational configuration, and the first and second drawing surface support members, the first and second lower support members, and at least a portion of the first and second rear support members form a bundle.

2. The portable drawing apparatus of claim 1, further comprising a hinged lateral member comprising two portions rotatable about a common pivot, wherein the hinged lateral member is connected at each of two ends to one of:

the first and second rear support members, the first and second drawing surface support members, and the first and second lower support members.

3. The portable drawing apparatus of claim 2, wherein the hinged lateral member is connected at each of two ends to the first and second rear support members, the portable drawing apparatus further comprising:

a front hinged lateral member comprising two portions pivotable about a common hinge, the front hinged lateral member connected at each of two ends to the first and second drawing surface support members; and a first and second side lateral member wherein each of the first and second side lateral members has a first end portion and a second end portion opposite to the first end portion, wherein the first end portion of the first side lateral member is connected to the first lower support member and the second end portion of the first side lateral member is connected to the first rear support member, and wherein the first end portion of the second side lateral member is connected to the second lower support member and the second end portion of the second side lateral member is connected to the second rear support member.

4. The portable drawing apparatus of claim 3, further comprising a lower lateral member coupled on opposite ends to the second end portions of the first and second rear support members.

5. The portable drawing apparatus of claim 1, wherein, when in the operational configuration, the first and second drawing surface support members are configured to hold the drawing support surface to provide a planar upwardly and rearwardly reclined surface.

6. The portable drawing apparatus of claim 1, wherein, when in the operational configuration, the first drawing surface support member is substantially parallel to the first lower support member, and the second drawing surface support member is substantially parallel to the second lower support member.

7. The portable drawing apparatus of claim 1, wherein the first and second drawing surface support members and the first and second lower support members are narrow elongated members, and wherein, when in the operational configuration:

the first drawing surface support member is substantially parallel to the first lower support member, the second drawing surface support member is substantially parallel to the second lower support member, and the first drawing surface support member and the first lower support member are laterally opposite to, spaced apart from, and substantially parallel to the second drawing surface support member and the second lower support member.

8. The portable drawing apparatus of claim 1, further comprising a drawing support surface connected to and held between the first and second drawing surface support members when in the operational configuration.

9. The portable drawing apparatus of claim 8, wherein the drawing support surface is removably attachable to the first and second drawing surface support members, and is removed from the first and second drawing surface support members when in the collapsed configuration.

10. The portable drawing apparatus of claim 8, wherein the drawing support surface comprises one of a rigid body configured to detach from the drawing support surface members in the operational configuration before collapsing the portable drawing apparatus and a compliant body configured to remain attached to the drawing surface support members whether in the operational configuration or the collapsed configuration.

11. The portable drawing apparatus of claim 10, wherein the rigid body comprises two panels that are reversibly joinable along a respective inner edge of each panel, and are each configured to connect to a respective drawing surface support member along an outer edge.

12. The portable drawing apparatus of claim 1, wherein the second end portion of the first rear support member is detachable from the first end portion of the first rear support member, wherein the second end portion of the second rear support member is detachable from the first end portion of the second rear support member, wherein the first end portion of the first rear support member is connected to the first drawing surface support member, wherein the first end portion of the second rear support member is connected to the second drawing surface support member, wherein the first end portion of the first cross frame member is attached to the first end portion of the first rear support member, wherein the first end portion of the second cross frame member is attached to the first end portion of the second rear support member, wherein, in the collapsed configuration with the second end portion of the first rear support member detached from the first end portion of the first rear support member and with the second end portion of the second rear support member detached from the first end portion of the second rear support member, a longitudinal dimension of the bundle is substantially less than a length of the portable drawing apparatus in the operational configuration.

13. The portable drawing apparatus of claim 12, wherein the second end portions of the first and second rear support members are curved.

14. The portable drawing apparatus of claim 1, wherein the first and second drawing surface support members, the first and second rear support members, and the first and second lower support members comprise one of elongated tubes and elongated rods.

15. The portable drawing apparatus of claim 1, further comprising a top member having a first end portion and a second end portion, wherein, in the operational configuration:

the first end portion of the top member is connected to the second end portion of the first drawing surface support member, the second end portion of the top member is connected to the second end portion of the second drawing surface support member, the top member is reversibly detachable to at least one of the first and second drawing surface support member, and the top member is configured to extend through a tube containing a consumable drawing medium sheet, to enable the drawing medium sheet to be pulled over an area between the first and second drawing surface support members.

16. The portable drawing apparatus of claim 1, further comprising one or more of:

a side pouch reversibly attachable to one of the first and second drawing surface support members;

a front tray reversibly connectable to a front region of the portable drawing apparatus; and a lower container reversibly attachable to the first and second lower support members and the first and second rear support members.

17. The portable drawing apparatus of claim 1, wherein the cross frame is a lower cross frame, wherein the second end portion of the first cross frame member of the lower cross frame is connected to the second lower support member, wherein the second end portion of the second cross frame member of the lower cross frame is connected to the first lower support member, and wherein the portable drawing apparatus further comprises:

an upper cross frame having first and second upper cross frame members, wherein each of the first and second upper cross frame members has a first end portion, an intermediate portion, and a second end portion opposite to the first end portion, wherein the first and second upper cross frame members are pivotally connected to each other at their intermediate portions, wherein the first end portion of the first upper cross frame member is connected to the first drawing surface support member, wherein the first end portion of the second upper cross frame member is connected to the second drawing surface support member, wherein the second end portion of the first upper cross frame member is connected to the second rear support member, and wherein the second end portion of the second upper cross frame member is connected to the first rear support member.

18. A portable easel comprising:

a drawing support surface;

a pair of upper support members being substantially mutually parallel and each configured to connect to the drawing support surface;

a pair of lower support members, each lower support member pivotally connected to a respective upper support member, wherein the upper support members and the lower support members are configured such that their distal ends can form a mutual angle with respect their pivotal connection that spans a range from about zero degrees to about one hundred eighty degrees;

a pair of rear support members each pivotally connected to one of an upper support member and a lower support member;

a cross frame comprising two members pivotally connected in their respective central regions, the cross frame connected on each of a first pair of distal ends to one of a respective lower support member and a respective upper support member, and the cross frame connected on each of a second pair of distal ends to a respective rear support member;

wherein, in an operational configuration, the upper support members are spaced apart from each other with the drawing support surface held in between, and wherein the upper support members hold the drawing support surface at an incline with respect to a substantially planar surface on which the rear support members and the lower support members are configured to rest, and wherein, in a collapsed configuration, the lower support members, upper support members, rear support members, and cross support members are collapsed in a bundle, and the upper and lower support members are configured such that their distal ends point in the same direction with respect to the pivotal connections of the upper and lower support members.

19. The portable easel of claim 18, further comprising a hinged lateral member having a central pivot and being connected on opposite ends to one of the pair of rear support members, the pair of lower support members, and the pair of upper support members, wherein the hinged lateral member comprises two portions rotatable about a common pivot and configured to engage into a locked position defining a substantially straight line when in the operational configuration.

20. A portable drawing apparatus, comprising:

a drawing support surface;

a pair of upper support members being substantially mutually parallel and each configured to connect to the drawing support surface;

a pair of lower support members, each lower support member pivotally connected to a respective upper support member, wherein the upper support and the lower support members are configured such that their distal ends can form a mutual angle with respect to the pivotal connection that spans a range from about zero degrees to about one hundred eighty degrees;

a pair of rear support members each pivotally connected to one of an upper support member and a lower support member;

a lower cross frame comprising two members pivotally connected in their respective central regions, the lower cross frame connected on each of a pair of distal ends to a respective lower support member and on each of a second pair of distal ends to a respective rear support member;

an upper cross frame comprising two members pivotally connected in their respective central regions, the upper cross frame connected on each of a pair of distal ends to a respective upper support member and on each of a second pair of distal ends to a respective rear support member;

wherein, in an operational configuration, the upper, lower, and rear support members define a substantially rigid easel in which the upper support members are spaced apart from each other with the drawing support surface held in between at an incline with respect to a substantially planar surface on which the rear support members and lower support members are configured to rest, and wherein, in a collapsed configuration, the lower support members, upper support members, rear support members, and upper and lower cross support members are collapsed in a bundle, and the upper and lower support members are configured such that their distal ends point in the same direction with respect to the pivotal connections of the upper and lower support members.

* * * * *